US006653050B2

(12) United States Patent
Fujimaki et al.

(10) Patent No.: US 6,653,050 B2
(45) Date of Patent: Nov. 25, 2003

(54) IMAGE-RECORDING MATERIAL

(75) Inventors: Kazuhiro Fujimaki, Shizuoka-ken (JP); Tadahiro Sorori, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 67 days.

(21) Appl. No.: 10/080,654

(22) Filed: Feb. 25, 2002

(65) Prior Publication Data

US 2002/0182539 A1 Dec. 5, 2002

(30) Foreign Application Priority Data

Feb. 23, 2001 (JP) ..... 2001-048827

(51) Int. Cl.[7] ..... G03F 7/038

(52) U.S. Cl. ..... 430/281.1; 430/284.1; 430/286.1; 430/288.1; 430/944; 430/945; 430/964

(58) Field of Search ..... 430/270.1, 281.1, 430/284.1, 286.1, 287.1, 288.1, 302, 348, 944, 945, 964

(56) References Cited

U.S. PATENT DOCUMENTS

| | | | | |
|---|---|---|---|---|
| 6,153,356 A | * 11/2000 | Urano et al. | ..... | 430/281.1 |
| 6,475,700 B1 | * 11/2002 | Higashi et al. | ..... | 430/278.1 |
| 2002/0086238 A1 | * 7/2002 | Fujimaki et al. | ..... | 430/281.1 |

FOREIGN PATENT DOCUMENTS

| | | | |
|---|---|---|---|
| JP | 08-108621 | 4/1996 | |
| JP | 09-034110 | 2/1997 | |
| JP | 2001-133969 | 5/2001 | |
| JP | 2001-312062 | * 11/2001 | ..... G03F/7/035 |

* cited by examiner

*Primary Examiner*—Janet Baxter
*Assistant Examiner*—Barbara Gilliam
(74) *Attorney, Agent, or Firm*—Burns, Doane, Swecker & Mathis, LLP

(57) ABSTRACT

A negative image-recording material for heat-mode exposure, which is able to form images by heat-mode exposure, comprises (A) a polyurethane resin having at least one or more side-chain branches of the following general formulae (1) to (3) which polyurethane resin is soluble in an alkaline aqueous solution, (B) a photo-thermal converting agent, and (C) a compound capable of generating a radical through heat-mode exposure to light of a wavelength which can be absorbed by the photo-thermal converting agent. In formulae (1) to (3), $R^1$ to $R^{11}$ each independently represents a monovalent organic group; X and Y each independently represents an oxygen atom, a sulfur atom, or —N($R^{12}$)—; Z represents an oxygen atom, a sulfur atom, —N($R^{13}$)—, or an optionally-substituted phenylene group; $R^{12}$ represents a hydrogen atom or a monovalent organic group; and $R^{13}$ represents a hydrogen atom or a monovalent organic group.

(1)

(2)

(3)

17 Claims, No Drawings

IMAGE-RECORDING MATERIAL

BACKGROUND OF THE INVENTION

1. Field of the Invention

The present invention relates to an image-recording material, and particularly to a negative image-recording material, which corresponds to heat-mode exposure which are able to form images by heat-mode exposure with an IR laser. Moreover, the present invention relates to a negative type image-recording material which is able to form planographic printing plates which have excellent resistance to printing and recording layers with high strength image areas.

2. Description of the Related Art

The recent development of laser technology has been remarkable; increases to output and miniaturization of solid lasers and semiconductor lasers which emit near-IR and IR rays (hereinafter referred to as IR lasers) are progressing. Such IR lasers are extremely useful as light sources in directly processing printing plate precursors from the digital data of computers or the like.

Negative type planographic printing plates which can be exposed by IR lasers use a negative type image recording material as an image recording layer, which image-recording material comprises an IR absorbent, a polymerization initiator, which generates a radical by light or heat, and a polymerizable compound. An ordinary recording system for the negative image-recording material of the type is as follows: The recording layer of the material is exposed to light or heat, and the radical initiator therein generates a radical. The radical acts on the polymerizable compound to initiate the polymerization of the compound, and the exposed area of the recording layer of the material is thereby cured to form an image area.

The image formability of the negative type image-forming materials of this type is low, as compared with that of positive type image-forming materials in which the recording layer is solubilized by laser energy when exposed by an IR laser. Before being developed, therefore, the negative type image-forming material is generally heated to promote the polymerization to cure the exposed area of the recording layer. Thus heated, the strength of the image area of the recorded layer of the material may be enhanced.

For printing plates the recording layer of which is made of the image-recording material of the type mentioned above, a technique of using a photopolymerizable or thermopolymerizable composition for the recording layer (photosensitive layer), for example, as in JP-A 8-108621 and 9-34110 is known. The recording layer disclosed is good, as its sensitivity is high and its image formability is good. However, when a hydrophilicated support is used for the recording layer, there have been problems in that the interfacial adhesiveness between the support and the layer is low and therefore the printing durability of the printing plates having the layer is low.

To increase the sensitivity of the image-recording material, using high-power IR lasers to expose the material to light has been studied. However, there have been problems in that the recording layer often undergoes ablation, when scanned with such high-power lasers, and stains the optical system used.

SUMMARY OF THE INVENTION

The present invention has been made in consideration of the problems noted above, and more specifically, an object of the present invention is to provide a negative type image-recording material which can form a planograpic printing plate having excellent resistance to printing and formed with high strength image areas.

We, the present inventors have assiduously studied the object, and, as a result, have found that, when a polyurethane resin having a specific unsaturated group in its side-chain branches and soluble in an alkaline aqueous solution is added to an image-recording material, then it enables good image recording on the material and an image area strength of the material is thereby enhanced.

Specifically, the object of the present invention is attained as follows.

In its first aspect, the present invention provides a negative image-recording material for heat-mode exposure, which is able to form images by heat-mode exposure, comprises a polyurethane resin having at least one or more side-chain branches of the following general formulae (1) to (3), which polyurethane resin is soluble in an alkaline aqueous solution; a photo-thermal converting agent; and a compound which generates a radical through heat-mode exposure to light of a wavelength which wavelength can be absorbed by the photo-thermal converting agent.

(1)

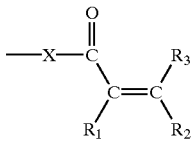

(2)

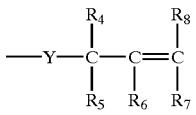

(3)

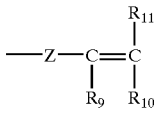

wherein $R^1$ to $R^{11}$ each independently represents a monovalent organic group; X and Y each independently represents an oxygen atom, a sulfur atom, or —N($R^{12}$)—; Z represents one of an oxygen atom, a sulfur atom, —N($R^{13}$)—, and an optionally-substituted phenylene group; $R^{12}$ represents a hydrogen atom or a monovalent organic group; and $R^{13}$ represents a hydrogen atom or a monovalent organic group.

A second embodiment of the negative type image-recording material for heat-mode exposure of the present invention is a negative type image-recording material for heat-mode exposure of the first embodiment, which further comprises a radical polymerizing compound.

Effects of the negative type image-recording material for heat-mode exposure of the present invention are unclear. By using the polyurethane resin as a polymer compound, which is soluble in alkali aqueous solution, it is possible to form a high-strength film, which is formed by hydrogen bonding of the principle-chain urethane group. Accordingly, when the image-recording material is used in the recording layer of planographic printing plate precursors for heat-mode exposure, it is believed that the recording layer will be prevented from ablating while being IR laser scan exposured, and therefore the negative image area will be prevented from being damaged and the optical system, such as the spinner mirror of the laser scanner used will be prevented from being stained.

In addition, since the polyurethane resin has good film formability, the dissolved oxygen content of the resin film is low. Further, as the barrier property of the polyurethane resin to oxygen from outside is good, polymerization inhibition of the radical polymerizing compounds by oxygen is suppressed. Through polymerization, therefore, the cured resin forms a hard film. Accordingly, when the polyurethane resin is used in the recording layer of planographic printing plate precursors, the image area formed in the layer is sufficiently cured, and, as a result, the printing plates from the precursors can have high printing durability.

Moreover, since the polyurethane resin for use in the present invention has a polar urethane group in its principle chain, it has good affinity for high-polar media such as water. Accordingly, the polyurethane resin is easily dispersible in water, as compared with alkali-soluble acrylic resins that are generally used in ordinary image-recording materials. Another advantage of the polyurethane resin is that, when it is used in the recording layer of planographic printing plate precursors, it is difficult for contaminants to form during development. Contaminants, if formed during development, interfere with smooth development.

In cases where the polyurethane resin of the present invention has an acidic hydrogen atom in the structure of the side-chain branches, it may form a high strength film by the hydrogen-bonding property of the atom. Therefore, it is thought that the polyurethane resin will contribute to the effect of improving the hardness of the image areas along with the effect of the functional groups, which are expressed by the formulae (1)–(3). When the polyurethane resin is used in the recording layer of planographic printing plate precursors, the molecules of the binder polymer are kept firmly bonding to each other via the hydrogen bonding between them in the step of developing the precursors with an alkaline developer. In this step, therefore, it is believed that the developer used will be prevented from penetrating into the precursors to lower the strength of the image area formed in the processed precursors.

In most cases of forming a cured film through radical polymerization in a recording layer, an oxygen barrier layer (protective layer) is generally formed on the recording layer to protect the recording layer from external oxygen that may inhibit the radical polymerization. Protected by such a protective layer, the reaction goes on in the recording layer, and a cured film of high strength is thereby formed. In the case of using the polyurethane resin (binder polymer) of the present invention, however, the polymer is immediately crosslinked soon after radical generation. In this case, therefore, the crosslinked area is efficiently insolubilized to form a cured film. Accordingly, the layer containing the polyurethane resin is influenced little by external oxygen, and can form a high strength film through hydrogen bonding of the resin. The degree of oxygen transmission through the recording layer is low, therefore, it becomes unnecessary to provide an additional oxygen barrier layer.

The present invention is for "heat-mode exposure", which means that the image-recording material may be recorded by heat-mode exposure. The definition of heat-mode exposure is described in detail. As disclosed in Hans-Joachim Timpe, IS & Ts NIP 15:1999 *International Conference on Digital Printing Technologies*, page 209, there are two major modes of the process comprising photo-excitation of a light-absorbing substance (e.g., dye) in a photographic material followed by chemical or physical change thereof for image formation in a layer of the material. Specifically, one is a photon mode of such that the photo-excited light-absorbing substance in a photographic material is inactivated through some photo-chemical interaction (for example, for energy transfer or electron transfer) with the other reactive substance in the material, and the reactive substance having been thus activated as a result of the interaction undergoes chemical or physical change necessary for image formation in a layer of the material, the so-called photon-mode; and the other is a heat mode of such that the photo-excited light-absorbing substance in a photographic material generates heat and is thus inactivated through the heat generation, and the other reactive substance in the material receives the heat and undergoes chemical or physical changes necessary for image formation in a layer of the material, the so-called heat-mode. The other minor modes of the process, for example, ablation of such that the substances in a photographic material are explosively scattered by some locally focused light energy, and poly-photon absorption of such that one molecule in a photographic material absorbs a number of photons all at one time, are omitted herein.

The exposure process of each mode is referred to as photon-mode exposure or as heat-mode exposure. The technical difference between photon-mode exposure and heat-mode exposure is whether or not the energy quantities from a plurality of photons for exposure can be added together for the intended reaction. For example, consider a reaction using a number, n, of photons. In the photon-mode exposure that utilizes photo-chemical interaction of the substances in a photographic material, the total amount of energy from the n photons cannot be added together to cause the reaction because of the laws of quantum energy and momentum conservation. In other words, every reaction through photon-mode exposure requires the condition that "amount of energy of one photon ≧ amount of energy for the reaction". In heat-mode exposure in contrast, the light-absorbing substance in a photographic material is first photo-excited to generate heat, and the heat thus converted from the light energy can be added to the reaction energy. Accordingly, in heat-mode exposure, the energy quantities of all n photons can be added together to cause image formation. Therefore, the condition that "amount of energy of n photons≧amount of energy for the reaction" will be sufficient for heat-mode exposure. However, the addition of the energy quantities in heat-mode exposure is restricted by heat diffusion therein. Namely, if successive light excitation or deactivation processes occur before heat leaves a part being exposed (a reaction point)and heat is produced, then the heat will surely accumulate, and be connected to an increase of the temperature of the part being exposed. However, if the successive heat production is late, the heat from the first process disperses and does not accumulate. Thus, even when a total amount of exposure energy is the same, the respective effects for the heat-mode exposure irradiating light at a high level of energy over a short period of time, and for the heat-mode exposure irradiating light at a low level of energy over a long period of time, are different. Accumulation of heat in the heat-mode exposure with a short time period is advantageous.

Needless-to-say, photon-mode exposure may also undergo the same phenomenon as above, by being influenced by the subsequent reaction diffusion, but is basically free from it.

The difference between photon-mode exposure and heat-mode exposure will be discussed with respect to the characteristics of a photographic material to be processed. In photon-mode exposure, the intrinsic sensitivity (the quantity of energy necessary for the reaction for image formation) of a photographic material is always constant relative to the exposure power density ($W/cm^2$) (=energy density per unit exposure time); but in heat-mode exposure, the intrinsic sensitivity thereof increases with the increase in the exposure power density. Now, the exposure time is fixed to be enough for the necessary processability of practicable image-recording materials, and the two modes are compared for the thus-fixed exposure time. In photon-mode exposure, in general, a low degree of energy of about 0.1 mJ/cm$^2$ or so may be enough for high-sensitivity exposure of the materials, but even a slight amount of exposure will cause photo-reaction in the materials. Therefore, in this mode, the materials often have a problem of low-exposure fogging. In contrast, in heat-mode exposure, the photographic materials do not undergo photo-reaction if the amount of exposure for them is not above a certain level. In this mode, in general, the photographic materials require a level of exposure energy of 50 mJ/cm$^2$ or so in view of their thermal stability, and are therefore free from the problem of low-exposure fogging.

In fact, in heat-mode exposure, photographic materials require an exposure power density of at least 5,000 W/cm$^2$ on their surface, preferably at least 10,000 W/cm$^2$. Though not described in detail, high-power density lasers of more than $5.0\times10^5$/cm$^2$ are undesirable, as they cause ablation and will soil light sources and other units.

DESCRIPTION OF THE PREFERRED EMBODIMENTS

An image-recording material of the present invention will be described in detail hereinafter.

The negative image-recording material of the present invention comprises (A) a polyurethane resin having at least one or more side-chain branches of formulae (1) to (3) mentioned below, which polyurethane resin is soluble in an alkaline aqueous solution (this will be hereinafter referred to as specific polyurethane resin), (B) a photo-thermal converting agent, and (C) a compound which generates a radical through heat-mode exposure to light of a wavelength can be absorbed by the photo-thermal converting agent the negative image-recording material is able to form images by heat-mode exposure.

The negative image-recording material of the present invention may further contain (D) a radical-polymerizing compound.

The compounds comprising the negative image-recording material of the present invention are described in detail hereinafter.

<(A) Specific Polyurethane Resin>

The specific polyurethane resin for use in the present invention has at least one or more side-chain branches of formulae (1) to (3) mentioned below, and is soluble in an alkaline aqueous solution. This polyurethane resin serves as a binder resin in the negative image-recording material of the present invention. The specific urethane resin shall have, in its structure, at least one side-chain branch of formulae (1) to (3), and may have all of them therein.

(A-1) Side-chain Branches of Specific Polyurethane Resin

The side-chain branches of formulae (1) to (3) of the specific polyurethane resin are described in detail.

(1)

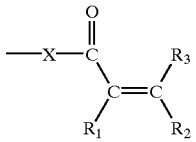

In formula (1), $R^1$ to $R^3$ each independently represents a monovalent organic group. $R^1$ is preferably a hydrogen atom, or an optionally-substituted alkyl group. More preferably, it is a hydrogen atom or a methyl group having high radical reactivity. Independently of each other, $R^2$ and $R^3$ may be any of a hydrogen atom, a halogen atom, an amino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group or an optionally-substituted arylsulfonyl group. Of those, a hydrogen atom, a carboxyl group, an alkoxycarbonyl group, an optionally-substituted alkyl group and an optionally-substituted aryl group, are preferred for $R^2$ and $R^3$ for having high radical reactivity.

X represents an oxygen atom, a sulfur atom, or —N($R^{12}$)—, in which $R^{12}$ represents a hydrogen atom or a monovalent organic group. $R^{12}$ is an optionally-substituted alkyl group, etc., for which a hydrogen atom, a methyl group, an ethyl group and an isopropyl group are preferable because they have high radical reactivity.

The substituent that may be in the groups includes, for example, an alkyl group, an alkenyl group, an alkynyl group, an aryl group, an alkoxy group, an aryloxy group, a halogen atom, an amino group, an alkylamino group, an arylamino group, a carboxyl group, an alkoxycarbonyl group, a sulfo group, a nitro group, a cyano group, an amido group, an alkylsulfonyl group, and an arylsulfonyl group.

(2)

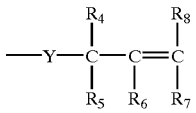

In formula (2), $R^4$ to $R^8$ each independently represents a monovalent organic group. For $R^4$ to $R^8$, a hydrogen atom, a halogen atom, an amino group, a dialkylamino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group and an optionally-substituted arylsulfonyl group are preferable. Of those, more preferable are a hydrogen atom, a carboxyl group, an alkoxycarbonyl group, an optionally-substituted alkyl group and an optionally-substituted aryl group, because they have high radical reactivity.

The substituent for the groups, may be the same as those mentioned above for the groups in formula (1). Y represents an oxygen atom, a sulfur atom, or —N($R^{12}$)—. $R^{12}$ has the same meaning as in formula (1); and for its preferred examples, referred to are those mentioned hereinabove for it in formula (1).

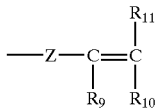

(3)

In formula (3), $R^9$ is preferably a hydrogen atom or an optionally-substituted alkyl group. More preferably, it is a hydrogen atom or a methyl group, because they have high radical reactivity. $R^{10}$ and $R^{11}$ may be independently any of a hydrogen atom, a halogen atom, an amino group, a dialkylamino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group and an optionally-substituted arylsulfonyl group. Of those, a hydrogen atom, a carboxyl group, an alkoxycarbonyl group, an optionally-substituted alkyl group and an optionally-substituted aryl group are preferable for having high radical reactivity.

The substituent in the groups may be the same as those mentioned above for the groups in formula (1). Z represents an oxygen atom, a sulfur atom, —N($R^{13}$)—, or an optionally-substituted phenylene group. $R^{13}$ is, for example, an optionally-substituted alkyl group, a methyl group, an ethyl group and an isopropyl group are preferable for having high radical reactivity.

(A-2) Basic Skeleton of Specific Polyurethane Resin

The basic skeleton of the specific polyurethane comprises structural units of a reaction product of at least one diisocyanate compound of the following general formula (4) and at least one diol compound of the following general formula (5).

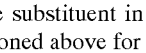

(4)

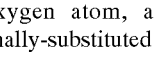

(5)

In formulae (4) and (5), $X^0$ and $Y^0$ each independently represents a divalent organic residue.

So far as at least any one of the diisocyanate compound of formula (4) and the diol compound of formula (5) has at least one group of formulae (1) to (3), the reaction product of the diisocyanate compound and the diol compound produces the specific polyurethane resin having at least one group of formulae (1) to (3). The method is preferable for introducing the desired side-chain branches into polyurethane resins previously prepared, as it produces the specific polyurethane resin easily.

1) Diisocyanate Compound

The diisocyanate compound of formula (4) includes, for example, products obtained through an addition reaction of a triisocyanate compound with 1 equivalent of a monofunctional alcohol having an unsaturated group or monofunctional amine compound having an unsaturated group.

Examples of the triisocyanate compound are mentioned below, to which examples, however, the present invention is not limited.

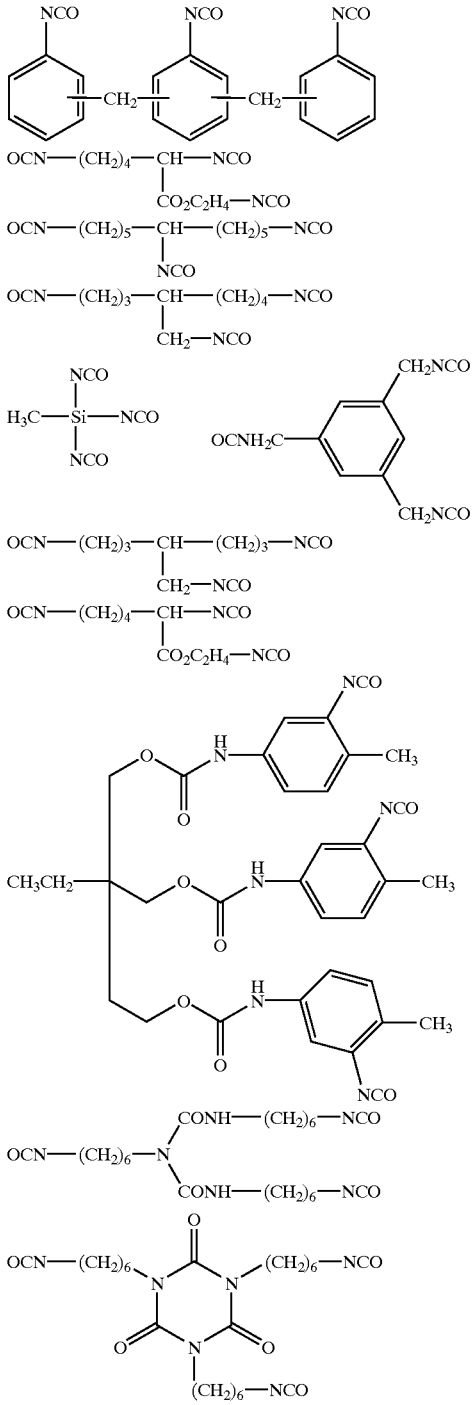

Examples of the monofunctional alcohol having an unsaturated group and monofunctional amine compound having an unsaturated group are mentioned below, to which examples, however, the present invention is not limited.

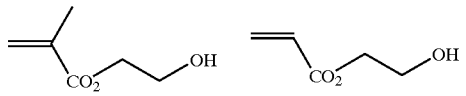

-continued

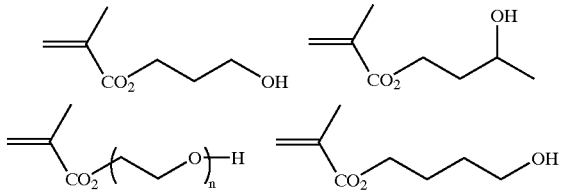

n is an integer of from 2 to 10

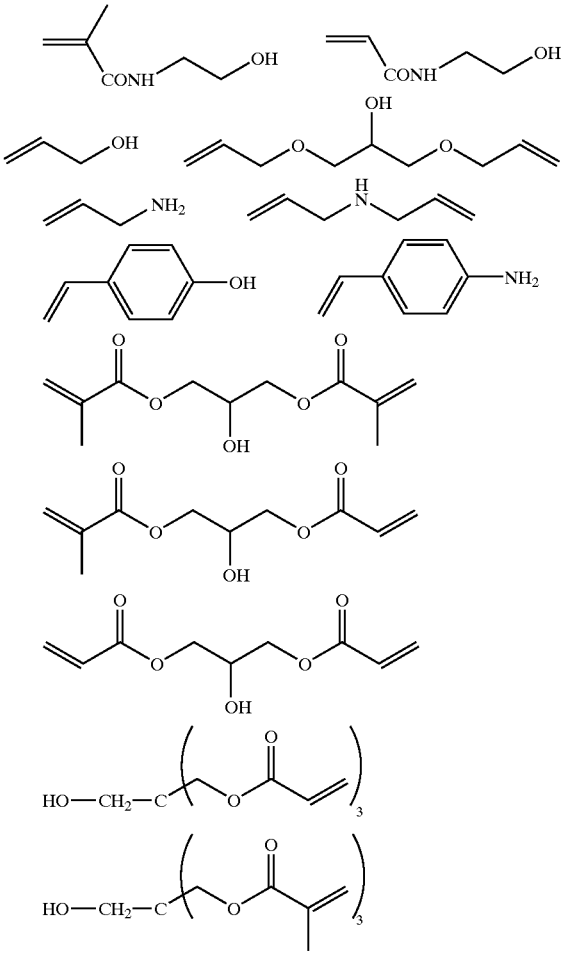

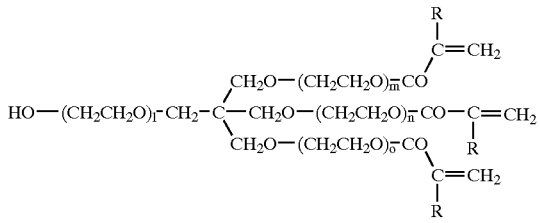

R = hydrogen or methyl group
l, m, n, o = integer of from 1 to 20

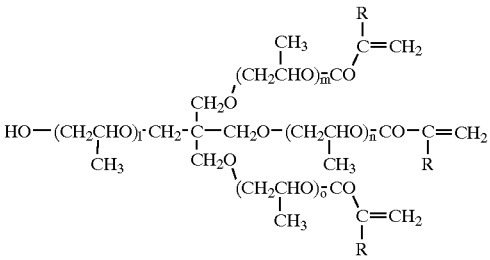

-continued

R = hydrogen or methyl group
l, m, n, o = integer of from 1 to 20

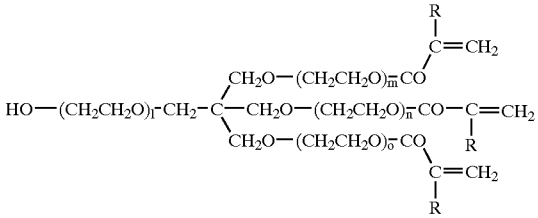

R = hydrogen or methyl group
l, m, n, o = integer of from 1 to 20

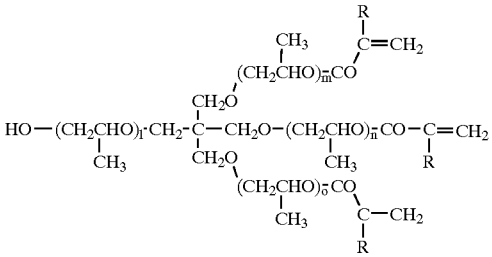

R = hydrogen or methyl group
l, m, n, o = integer of from 1 to 20

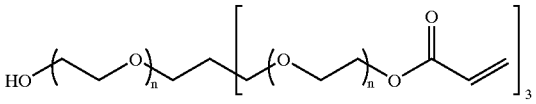

n = integer of from 1 to 20

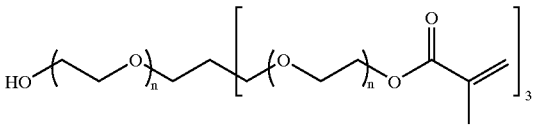

n = integer of from 1 to 20

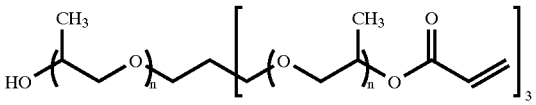

n = integer of from 1 to 20

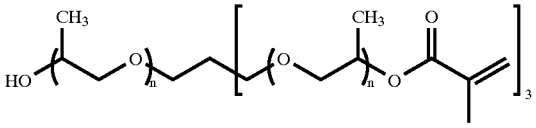

n = integer of from 1 to 20

A preferable method for introducing an unsaturated group into the side-chain branches of polyurethane resin uses, as the starting material, a diisocyanate compound having an unsaturated side-chain branch. Examples of the diisocyanate compound obtained through addition reaction of a triisocyanate compound with one equivalent of a monofunctional alcohol having an unsaturated group or monofunctional amine compound having an unsaturated group and having an unsaturated side-chain branch are mentioned below, to which, however, the present invention is not limited.

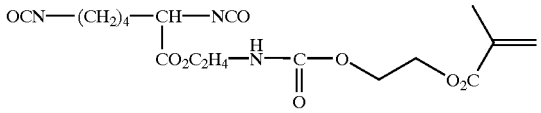
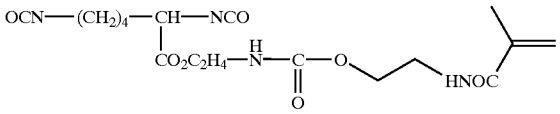
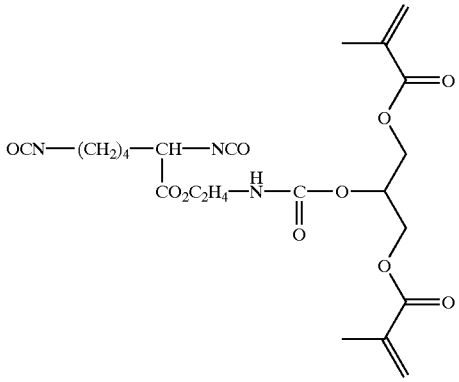
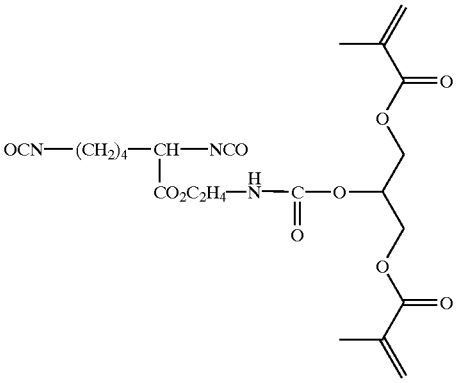
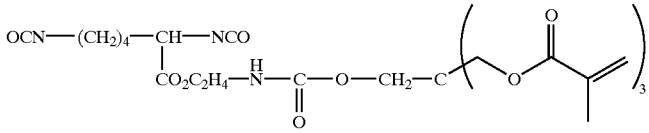
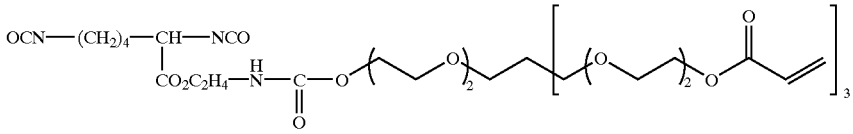
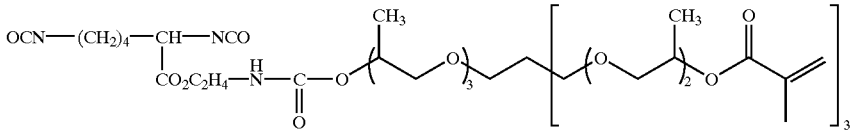
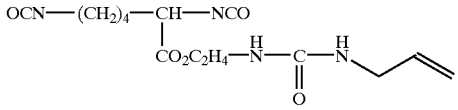
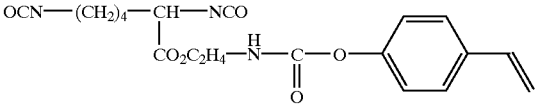
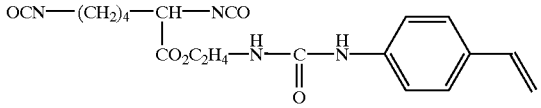
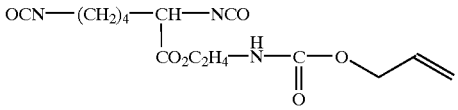
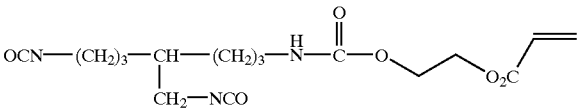
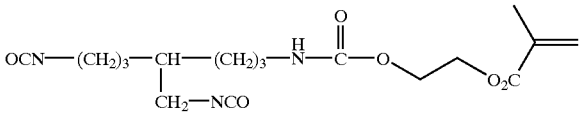
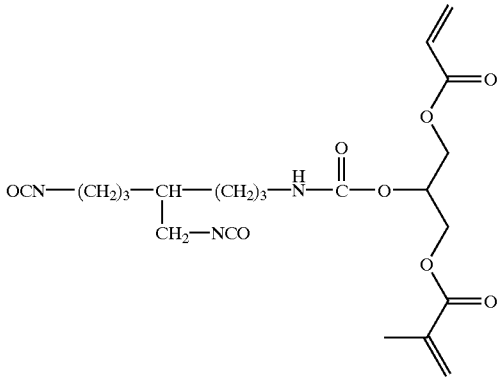

-continued
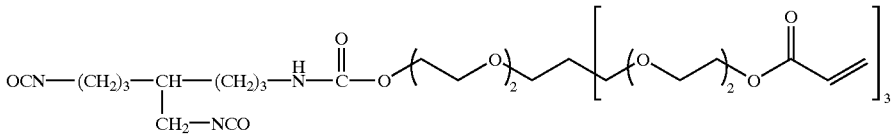
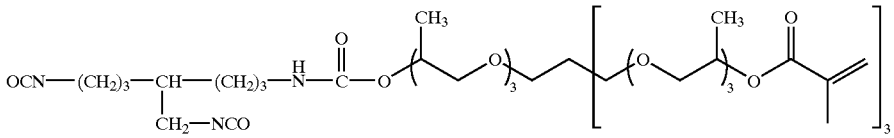
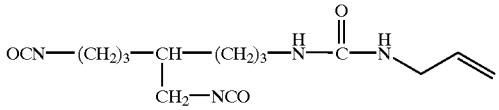
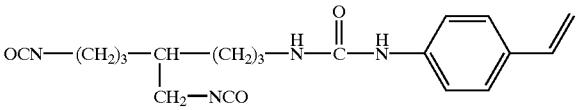
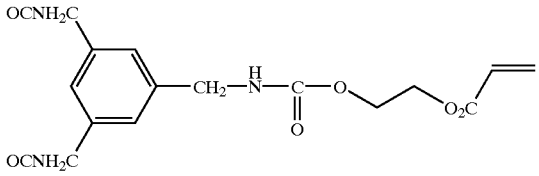
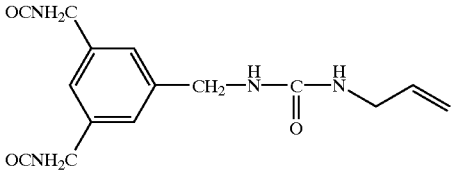
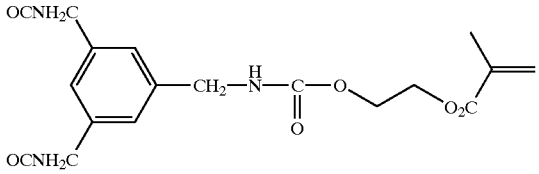
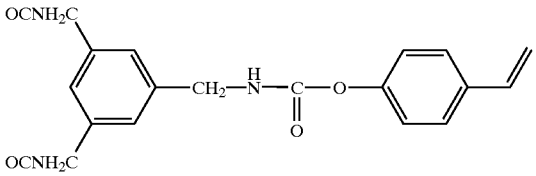
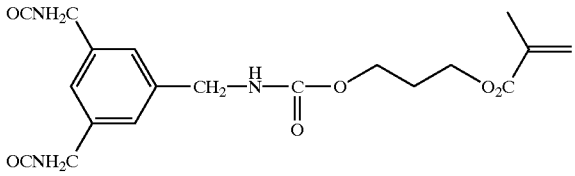
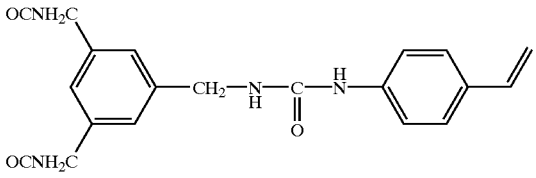
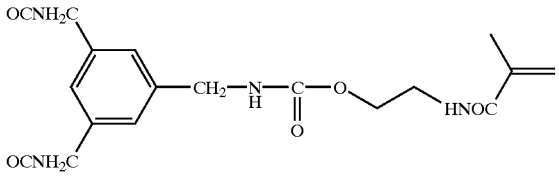
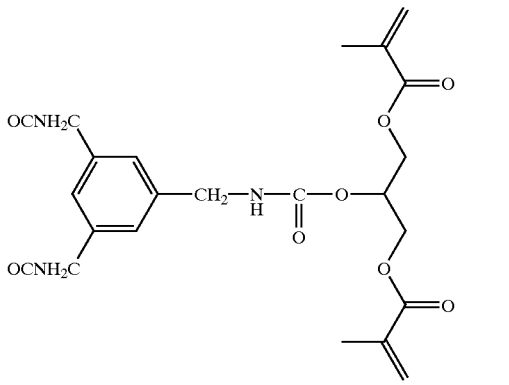

-continued
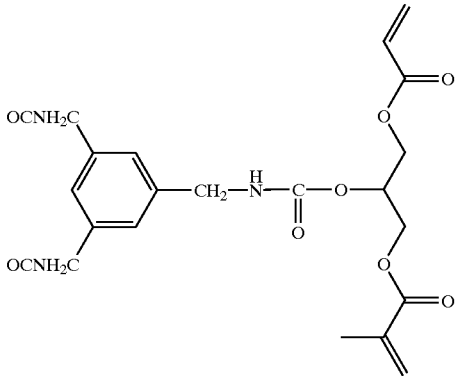
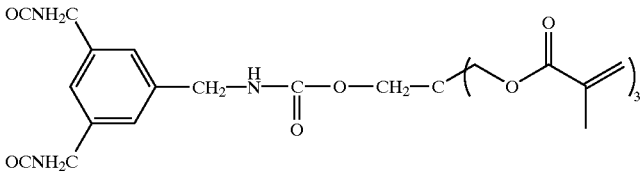
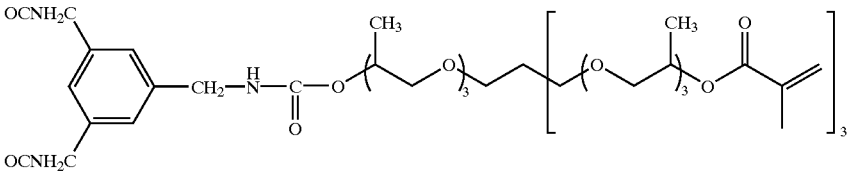
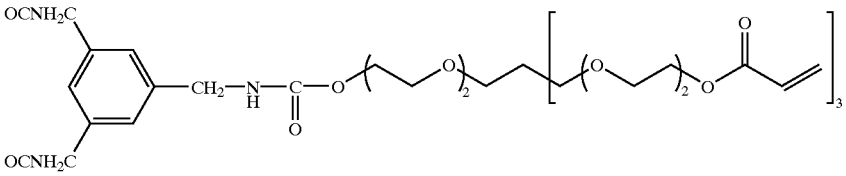
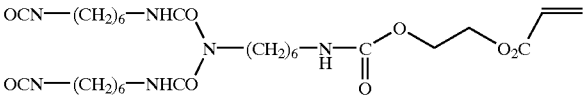
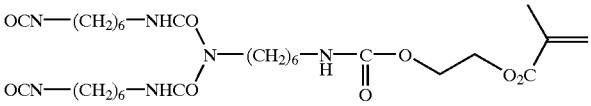
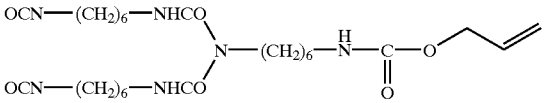
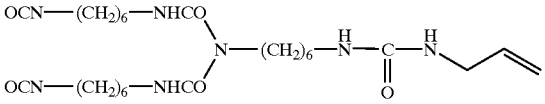
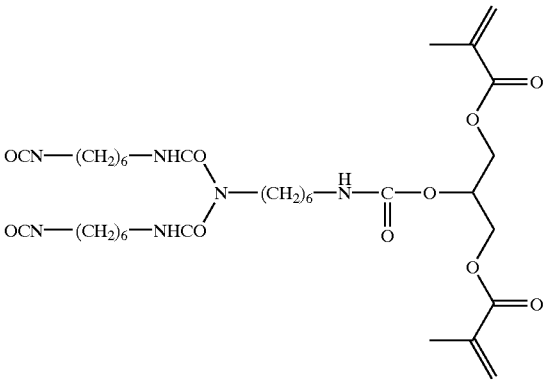
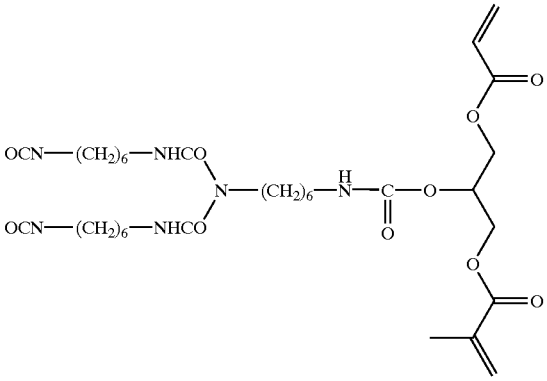
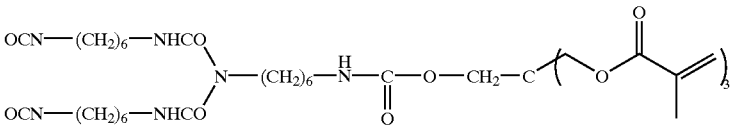
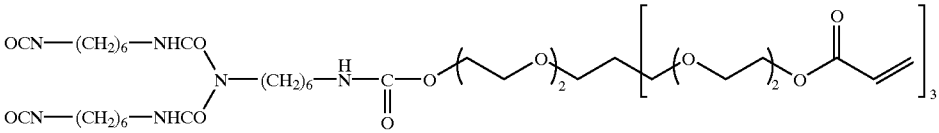

-continued

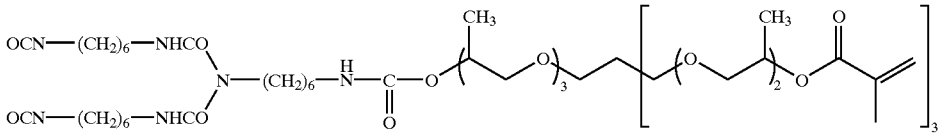

The specific polyurethane resin for use in the present invention may be copolymerized with diisocyanate compounds other than the above-mentioned, diisocyanate compound having an unsaturated group, for example, to improve its compatibility with some other components of the resin composition and to improve the storage stability of the resin.

The copolymerizable diisocyanate compound is described below. Preferable are diisocyanate compounds of the following general formula (6):

$$OCN—L^1—NCO \quad (6)$$

In formula (6), $L^1$ represents an optionally-substituted, divalent aliphatic or aromatic hydrocarbon group. If desired, $L^1$ may have other functional groups which do not reacting with an isocyanate group. The additional functional group includes, for example, an ester group, an urethane group, an amido group and an ureido group.

Examples of the diisocyanate compound of formula (6) are:

Aromatic diisocyanate compounds such as 2,4-tolylene diisocyanate, 2,4-tolylene diisocyanate dimer, 2,6-tolylene diisocyanate, p-xylylene diisocyanate, m-xylylene diisocyanate, 4,4'-diphenylmethane diisocyanate, 1,5-naphthylene diisocyanate, 3,3'-dimethylbiphenyl 4,4'-diisocyanate;

aliphatic diisocyanates such as hexamethylene diisocyanate, trimethylhexamethylene diisocyanate, lysine diisocyanate, dimer acid diisocyanates;

alicyclic diisocyanates such as isophorone diisocyanate, 4,4'-methylenebis(cyclohexyl isocynate), methylcyclohexane 2,4 (or 2,6)-diisocyanate, 1,3-(isocyanatomethyl) cyclohexane;

Diisocyanates which are reaction products of diols and diisocyanates, such as adduct of 1 mol of 1,3-butylene glycol and 2 mols of tolylene diisocyanate.

2) Diol Compound

The diol compounds of formula (5) broadly include, for example, polyether-diol compounds, polyester-diol compounds, and polycarbonate-diol compounds. Preferably, the diol compounds of formula (5) contain at least one diol compound having at least one group of the formulae (1) to (3); and at least one other diol compound selected from a group consisting of polyether-diol compounds, polyester-diol compounds and polycarbonate-diol compounds, the polyether-diol compounds, the polyester-diol compounds and the polycarbonate-diol compounds each having a weight-average molecular weight of at least 500.

A preferred method for introducing an unsaturated group into the side-chain branches of polyurethane resin, is using, as the starting material for polyurethane resin, a diol compound having an unsaturated side-chain branch, in addition to the method mentioned above. The diol compound may be a commercial product, trimethylolpropane monoallyl ether, and may also be those readily produced through reaction of any of halogenodiol compounds, triol compounds or aminodiol compounds with any of unsaturated group-having carboxylic acids, acid chlorides, isocyanates, alcohols, amines, thiols or halogenoalkyl compounds. Examples of the compounds are mentioned below, to which examples, however, the present invention is not limited.

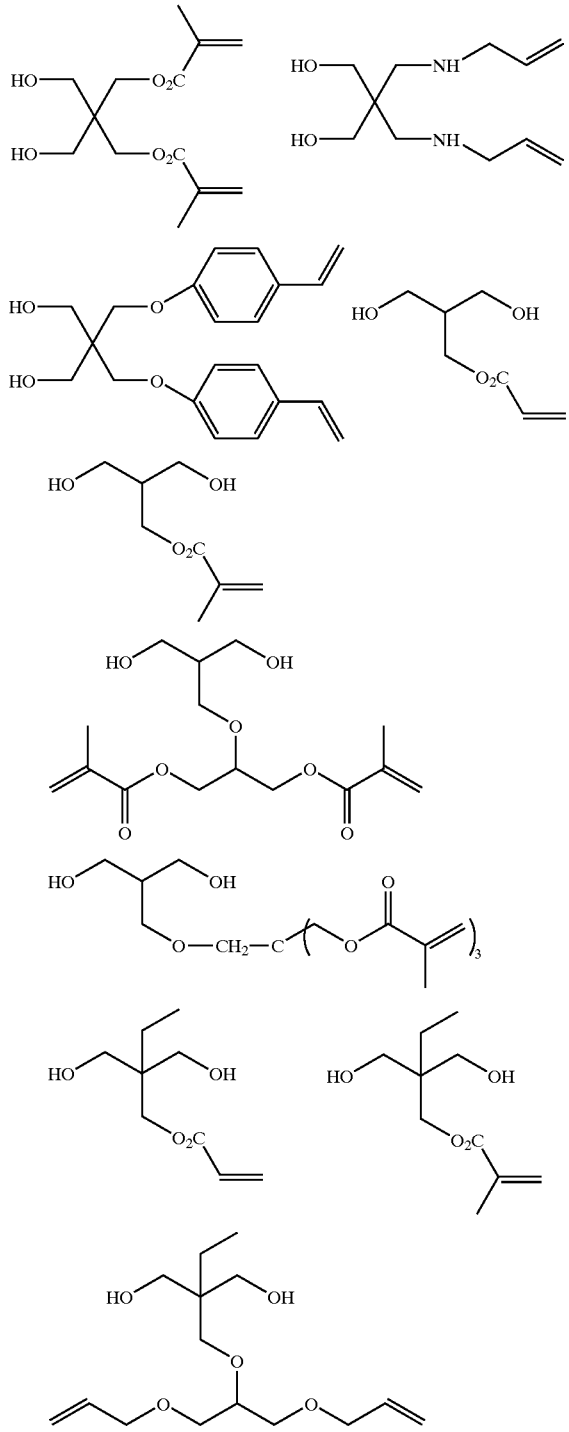

-continued
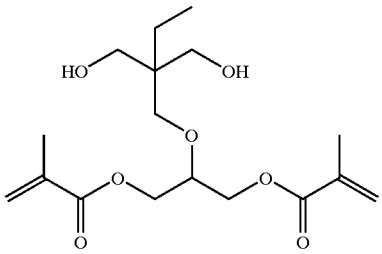
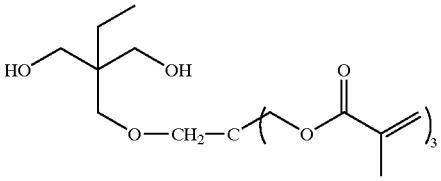
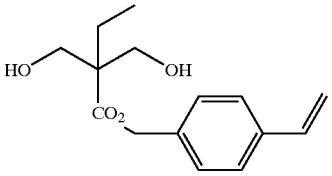
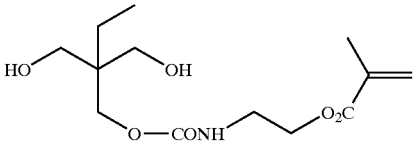
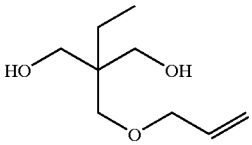
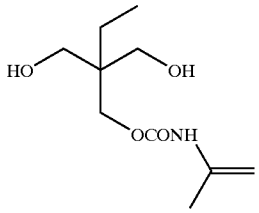
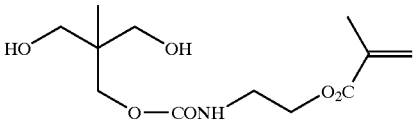
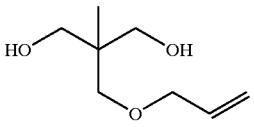
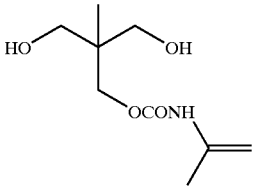
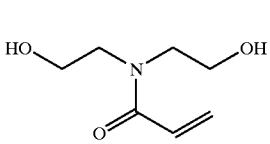
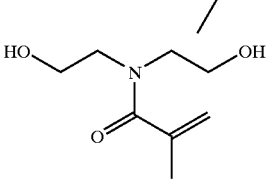
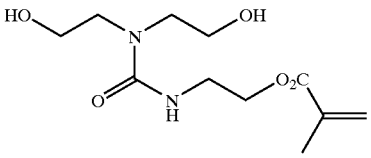
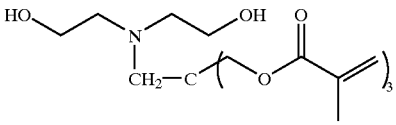
-continued
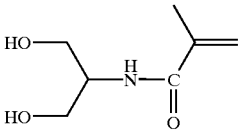
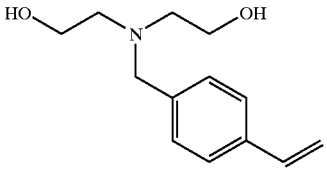
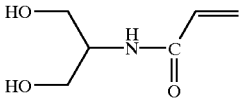
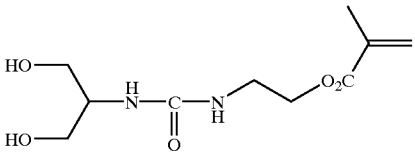
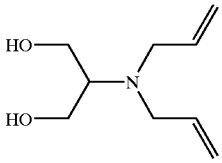
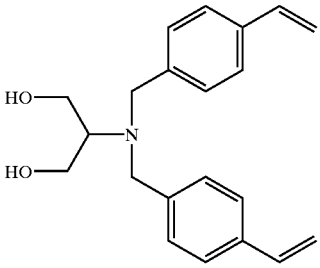
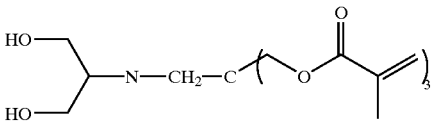
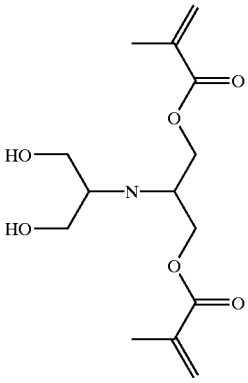
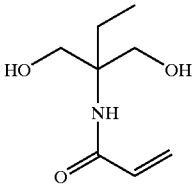
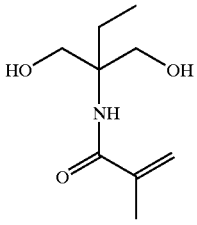
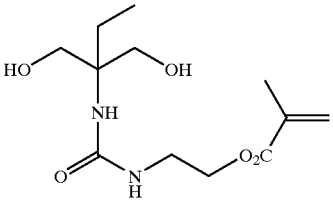
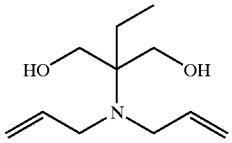
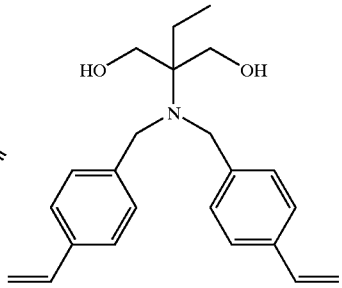

-continued

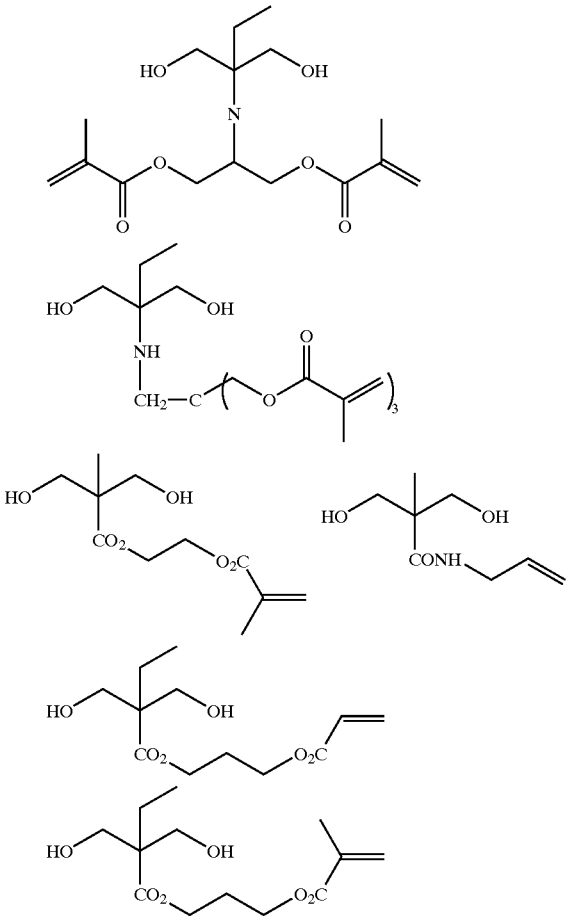

The specific polyuerthane resin for use in the present invention may be copolymerized with diol compounds other than the above-mentioned, diol compound having an unsaturated group, for example, to improve its compatibility with some other components of the resin composition and for improve the storage stability of the resin.

The copolymerizable diol compound includes, for example, polyether-diol compounds, polyester-diol compounds and polycarbonate-diol compounds such as those mentioned above.

Examples of the polyether-diol compounds are those of the following formulae (7), (8), (9), (10) and (11), and random copolymers of OH-terminated ethylene oxide and propylene oxide.

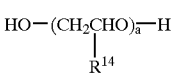

(7)

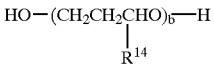

(8)

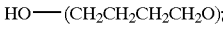

(9)

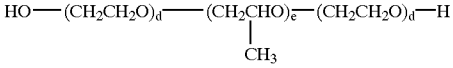

(10)

-continued

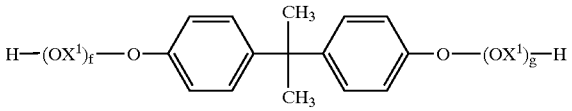

(11)

In formulae (7) to (11), $R^{14}$ represents a hydrogen atom or a methyl group; $X^1$ represents a group mentioned below; and a, b, c, d, e, f, g each indicates an integer of 2 or more, preferably from 2 to 100.

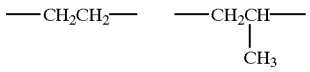

Examples of the polyether-diol compounds of formulae (7) and (8) are:

Diethylene glycol, triethylene glycol, tetraethylene glycol, pentaethylene glycol, hexaethylene glycol, heptaethylene glycol, octaethylene glycol, di-1,2-propylene glycol, tri-1,2-propylene glycol, tetra-1,2-propylene glycol, hexa-1,2-propylene glycol, di-1,3-propylene glycol, tri-1,3-propylene glycol, tetra-1,3-propylene glycol, di-1,3-butylene glycol, tri-1,3-butylene glycol, hexa-1,3-butylene glycol, polyethylene glycol having a weight-average molecular weight of 1000, polyethylene glycol having a weight-average molecular weight of 1500, polyethylene glycol having a weight-average molecular weight of 2000, polyethylene glycol having a weight-average molecular weight of 3000, polyethylene glycol having a weight-average molecular weight of 7500, polypropylene glycol having a weight-average molecular weight of 400, polypropylene glycol having a weight-average molecular weight of 700, polypropylene glycol having a weight-average molecular weight of 1000, polypropylene glycol having a weight-average molecular weight of 2000, polypropylene glycol having a weight-average molecular weight of 3000, polypropylene glycol having a weight-average molecular weight of 4000.

Examples of the polyether-diol compounds of formula (9) are:

Sanyo Chemical Industries' PTMG650, PTMG1000, PTMG2000, PTMG3000 (trade names).

Examples of the polyether-diol compounds of formula (10) are:

Sanyo Chemical Industries' NEWPOL PE-61, NEWPOL PE-62, NEWPOL PE-64, NEWPOL PE-68, NEWPOL PE-71, NEWPOL PE-74, NEWPOL PE-75, NEWPOL PE-78, NEWPOL PE-108, NEWPOL PE-128, NEWPOL PE-61 (trade names).

Examples of the polyether-diol compounds of formula (11) are:

Sanyo Chemical Industries' NEWPOL BPE-20, NEWPOL BPE-20F, NEWPOL BPE-20NK, NEWPOL BPE-20T, NEWPOL BPE-20G, NEWPOL BPE-40, NEWPOL BPE-60, NEWPOL BPE-100, NEWPOL BPE-180, NEWPOL BPE-2P, NEWPOL BPE-23P, NEWPOL BPE-3P, NEWPOL BPE-5P (trade names).

Examples of the random copolymers of OH-terminated ethylene oxide and propylene oxide are:

Sanyo Chemical Industries' NEWPOL 50HB-100, NEWPOL 50HB-260, NEWPOL 50OHB-400, NEWPOL 50HB-660, NEWPOL 50HB-2000, NEWPOL 50HB-5100 (trade names).

Examples of the polyester-diol compounds are those of the following formulae (12) and (13).

(12)

$$HO-L^2-(O-\overset{O}{\overset{\|}{C}}-L^3-\overset{O}{\overset{\|}{C}}-O-L^2)_{n1}-OH$$

(13)

$$HO-L^4-(O-\overset{O}{\overset{\|}{C}}-L^5)_{n2}-OH$$

In formulae (12) and (13), $L^2$, $L^3$ and $L^4$ may be the same or different, each representing a divalent aliphatic or aromatic hydrocarbon group; and $L^5$ represents a divalent aliphatic hydrocarbon group. Preferably, $L^2$ to $L^4$ each represents an alkylene group, an alkenylene group, an alkynylene group or an arylene group, and $L^5$ represents an alkylene group. $L^2$ to $L^5$ may have any other functional group not reacting with an isocyanate group. The additional functional group includes, for example, an ether group, a carbonyl group, an ester group, a cyano group, an olefin group, an urethane group, an amido group, an ureido group, and a halogen atom. n1 and n2 each indicate an integer of 2 or more, preferably from 2 to 100.

Examples of the polycarbonate-diol compounds are those of the following formula (14).

(14)

$$HO-L^6-(O-\overset{O}{\overset{\|}{C}}-L^6)_{n3}-OH$$

In formula (14), $L^6$'s may be the same or different, each representing a divalent aliphatic or aromatic hydrocarbon group. Preferably, $L^6$ is an alkylene group, an alkenylene group, an alkynylene group, or an arylene group. $L^6$ may have any other functional group not reacting with an isocyanate group. The additional functional group includes, for example, an ether group, a carbonyl group, an ester group, a cyano group, an olefin group, an urethane group, an amido group, an ureido group, and a halogen atom. n3 indicates an integer of 2 or more, preferably from 2 to 100.

Specifically, the diol compounds of formulae (12), (13) and (14) include Compound No. 1 to Compound No. 18 mentioned below, in which n indicates an integer of 2 or more.

(No. 1)

$$HO-CH_2CH_2-(O\overset{O}{\overset{\|}{C}}CH_2CH_2-\overset{O}{\overset{\|}{C}}OCH_2CH_2)_n-OH$$

(No. 2)

$$HO-CH_2CH_2-(O\overset{O}{\overset{\|}{C}}(CH_2)_4-\overset{O}{\overset{\|}{C}}OCH_2CH_2)_n-OH$$

(No. 3)

$$HO-(CH_2)_4-(O\overset{O}{\overset{\|}{C}}(CH_2)_4-\overset{O}{\overset{\|}{C}}O(CH_2)_4)_n-OH$$

(No. 4)

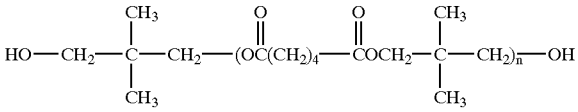

(No. 5)

$$HO-CH_2CH_2OCH_2CH_2-(O\overset{O}{\overset{\|}{C}}(CH_2)_4-\overset{O}{\overset{\|}{C}}OCH_2CH_2OCH_2CH_2)_n-OH$$

-continued (No. 6)

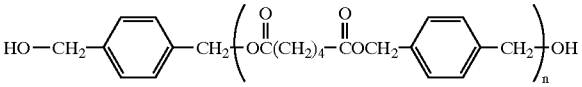

(No. 7)

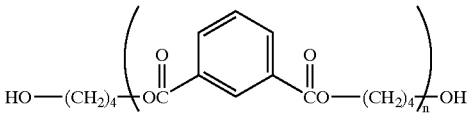

(No. 8)

$$HO-CH_2CH_2-(O\overset{O}{\overset{\|}{C}}(CH_2)_5)_n-OH$$

(No. 9)

$$HO-(CH_2)_6-(O\overset{O}{\overset{\|}{C}}O(CH_2)_6)_n-OH$$

(No. 10)

$$HO-(CH_2)_5-(O\overset{O}{\overset{\|}{C}}O(CH_2)_5)_n-OH$$

(No. 11)

$$HO-(CH_2)_4-(O\overset{O}{\overset{\|}{C}}O(CH_2)_4)_n-OH$$

(No. 12)

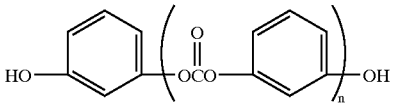

(No. 13)

$$HO-CH_2CH=CHCH_2-\left[O\underset{\underset{O}{\|}}{C}(CH_2)_4\underset{\underset{O}{\|}}{C}O-CH_2CH=CHCH_2O\right]_n-H$$

(No. 14)

$$HO-CH_2CH_2-\left[O\underset{\underset{O}{\|}}{C}CH=CH\underset{\underset{O}{\|}}{C}O-CH_2CH_2O\right]_n-H$$

(No. 15)

$$HO-CH_2CH=CHCH_2-\left[O\underset{\underset{O}{\|}}{C}CH=CH\underset{\underset{O}{\|}}{C}O-CH_2CH=CHCH_2O\right]_n-H$$

(No. 16)

$$HO-CH_2C\equiv CCH_2-\left[O\underset{\underset{O}{\|}}{C}(CH_2)_4\underset{\underset{O}{\|}}{C}O-CH_2C\equiv CCH_2O\right]_n-H$$

(No. 17)

$$HO-(CH_2)_m-\left[O\underset{\underset{O}{\|}}{C}(CH_2)_4\underset{\underset{O}{\|}}{C}O-(CH_2)_mO\right]_n-H$$

m = 2, 4

To produce the specific polyurethane resin, the diol compound mentioned above may be combined with another diol compound having a substituent which does not react with an isocyanate group.

The additional diol compound of that type includes, for example, the following:

$$HO-L^7-O-CO-L^8-CO-O-L^7-OH \quad (15)$$

$$HO-L^8-CO-O-L^7-OH \quad (16)$$

In formulae (15) and (16), $L^7$ and $L^8$ may be the same or different, each representing a divalent, aliphatic hydrocarbon, aromatic hydrocarbon or heterocyclic group optionally having a substituent (e.g., alkyl group, aralkyl group, aryl group, alkoxy group, aryloxy group, halogen such as —F, —Cl, —Br or —I). If desired, $L^7$ and $L^8$ may have any other functional group not reacting with an isocyanate group. The additional functional group may include, for example, a carbonyl group, an ester group, an urethane group, an amido group, and an ureido group. $L^7$ and $L^8$ may form a ring.

For producing the specific polyurethane resin, the diol compound mentioned above may be combined with another diol compound having a carboxyl group.

The additional diol compound of that type includes, for example, those of the following general formulae (17) to (19).

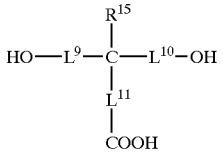

(17)

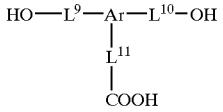

(18)

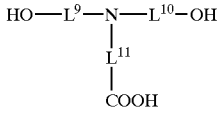

(19)

In formulae (17) to (19), $R^{15}$ represents a hydrogen atom, or an alkyl, aralkyl, aryl, alkoxy or aryloxy group optionally having a substituent (e.g., cyano, nitro, halogen such as —F, —Cl, —Br or —I, —$CONH_2$, —$COOR^{16}$, —$OR^{16}$, —$NHCONHR^{16}$, —$NHCOOR^{16}$, —$NHCOR^{16}$, —$OCONHR^{16}$ (in which $R^{16}$ represents an alkyl group having from 1 to 10 carbon atoms, or an aralkyl group having from 7 to 15 carbon atoms)). Preferably, it is a hydrogen atom, an alkyl group having from 1 to 8 carbon atoms, or an aryl group having from 6 to 15 carbon atoms. $L^9$, $L^{10}$ and $L^{11}$ may be the same or different, each representing a single bond, or a divalent aliphatic or aromatic hydrocarbon group optionally having a substituent (preferably, for example, any of alkyl, aralkyl, aryl, alkoxy or halogen). Preferably, they independently represent an alkylene group having from 1 to 20 carbon atoms, or an arylene group having from 6 to 15 carbon atoms, more preferably an alkylene group having from 1 to 8 carbon atoms. If desired, $L^9$ to $L^{11}$ may have another functional group not which does not react with an isocyanate group. The additional functional group includes, for example, a carbonyl group, an ester group, an urethane group, an amido group, an ureido group, and an ether group. Two or three of $R^{15}$, $L^7$, $L^8$ and $L^9$ may form a ring.

Ar represents an optionally-substituted, trivalent aromatic hydrocarbon group, and is preferably an aromatic group having from 6 to 15 carbon atoms.

Examples of the carboxyl group-having diol compounds of formulae (17) to (19) are:

3,5-Dihydroxybenzoic acid, 2,2-bis(hydroxymethyl) propionic acid, 2,2-bis(2-hydroxyethyl)propionic acid, 2,2-bis(3-hydroxypropyl)propionic acid, bis(hydroxymethyl) acetic acid, bis(4-hydroxyphenyl)acetic acid, 2,2-bis (hydroxymethyl)butyric acid, 4,4-bis(4-hydroxyphenyl) pentanoic acid, tartaric acid, N,N-dihydroxyethylglycine, N,N-bis(2-hydroxyethyl)-3-carboxy-propionamide.

For producing the specific polyurethane resin, the diol compound mentioned above may be combined with a compound resulting from ring cleavage of a tetracarboxylic acid dianhydride of the following general formulae (20) to (22) with a diol compound.

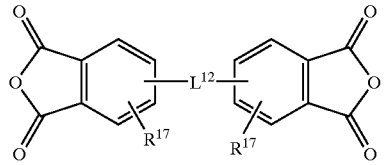

(20)

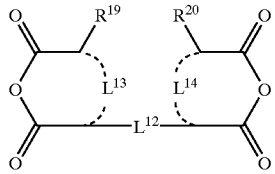

(21)

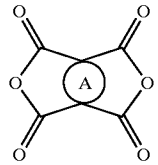

(22)

In formulae (20) to (22), $L^{12}$ represents a single bond, a divalent aliphatic or aromatic hydrocarbon group optionally having a substituent (preferably, for example, any of alkyl, aralkyl, aryl, alkoxy, halogen, ester or amide), or —CO—, —SO—, —$SO_2$—, —O— or —S—. A single bond, a divalent aliphatic hydrocarbon group having from 1 to 15 carbon atoms, or —CO—, —$SO_2$—, —O— or —S— are preferable. $R^{17}$ and $R^{18}$ may be the same or different, each representing a hydrogen atom, an alkyl group, an aralkyl group, an aryl group, an alkoxy group or a halogen atom, preferably a hydrogen atom, an alkyl group having from 1 to 8 carbon atoms, an aryl group having from 6 to 15 carbon atoms, an alkoxy group having from 1 to 8 carbon atoms, or a halogen atom. Two of $L^{12}$, $R^{17}$ and $R^{18}$ may be bonded to each other to form a ring.

$R^{19}$ and $R^{20}$ may be the same or different, each representing a hydrogen atom, an alkyl group, an aralkyl group, an aryl group or a halogen atom, preferably a hydrogen atom, an alkyl group having from 1 to 8 carbon atoms, or an aryl group having from 6 to 15 carbon atoms. Two of $L^{12}$, $R^{19}$ and $R^{20}$ may be bonded to each other to form a ring. $L^{13}$ and $L^{14}$ may be the same or different, each representing a single bond, a double bond, or a divalent aliphatic hydrocarbon group, preferably a single bond, a double bond, or a methylene group. A represents a monocyclic or polycyclic aromatic ring. Preferably, it is an aromatic ring having from 6 to 18 carbon atoms.

Examples of the compounds of formulae (20), (21) and (22) are:

pyromellitic acid dianhydride, 3,3',4,4'-benzophenonetetracarboxylic acid dianhydride, 3,3',4,4'-diphenyltetracarboxylic acid dianhydride, 2,3,6,7-napthalenetetracarboxylic acid dianhydride, 1,4,5,8-naphthalenetetracarboxylic acid dianhydride, 4,4'-sulfonyldiphthalic acid dianhydride, 2,2-bis(3,4-dicarboxyphenyl)propane dianhydride, bis(3,4-dicarboxyphenyl)ether dianhydride, 4,4'-[3,3'-(alkylphosphoryldiphenylene)-bis(iminocarbonyl)] diphthalic acid dianhydride; and aromatic tetracarboxylic acid dianhydrides such as adduct of hydroquinone diacetate and trimellitic acid anhydride, adduct of diacetyldiamine and trimellitic acid anhydride; alicyclic tetracarboxylic acid dianhydrides such as 5-(2,5-dioxotetrahydrofuryl)-3-methyl-3-cyclohexene-1,2-dicarboxylic acid dianhydride (Dai-Nippon Ink's EPICLON B-4400), 1,2,3,4-cyclopentanetetracarboxylic acid dianhydride, 1,2,4,5-cyclohexanetetracarboxylic acid dianhydride, tetrahydrofurantetracarboxylic acid dianhydride; aliphatic tetracarboxylic acid dianhydrides such as 1,2,3,4-butanetetracarboxylic acid dianhydride, 1,2,4,5-pentanetetracarboxylic acid dianhydride.

To introduce the compound that results from ring cleavage of the tetracarboxylic acid dianhydride with a diol compound, into polyurethane resin, for example, the following methods may be used.

a) An alcohol-terminated compound that results from ring cleavage of a tetracarboxylic acid dianhydride with a diol compound is reacted with a diisocyanate compound.

b) An alcohol-terminated urethane compound prepared through reaction of a diisocyanate compound with an excess amount of a diol compound is reacted with a tetracarboxylic acid dianhydride.

The diol compound to be used for the ring cleave reaction includes, for example, the following:

Ethylene glycol, diethylene glycol, triethylene glycol, tetraethylene glycol, propylene glycol, dipropylene glycol, polyethylene glycol, polypropylene glycol, neopentyl glycol, 1,3-butylene glycol, 1,6-hexanediol, 2-butene-1,4-diol, 2,2,4-trimethyl-1,3-pentanediol, 1,4-bis-β-hydroxyethoxycyclohexane, cyclohexanedimethanol, tricyclodecanedimethanol, hydrogenated bisphenol A, hydrogenated bisphenol F, bisphenol A/ethylene oxide adduct, bisphenol A/propylene oxide adduct, bisphenol F/ethylene oxide adduct, bisphenol F/propylene oxide adduct, hydrogenated bisphenol A/ethylene oxide adduct, hydrogenated bisphenol A/propylene oxide adduct, hydroquinone dihydroxyethyl ether, p-xylylene glycol, dihydroxyethyl sulfone, bis(2-hydroxyethyl)-2,4-tolylene dicarbamate, 2,4-tolylene-bis(2-hydroxyethylcarbamide), bis(2-hydroxyethyl)-m-xylylene dicarbamate, bis(2-hydroxyethyl)isophthalate.

(A-3) Preferred Embodiments of Specific Polyurethane Resin

The specific polyurethane resin for use in the present invention is produced by heating the above-mentioned diisocyanate compound and diol compound in an aprotic solvent in the presence of a known catalyst added thereto. The catalyst is so selected that its activity corresponds to the reactivity of the reactants. The molar ratio ($M_a$:$M_b$) of the diisocyanate compound ($M_a$) to the diol compound ($M_b$) to be used for the production preferably is from 1:1 to 1.2:1. Treated with any of alcohols or amines, the final product, polyurethane resin may be so controlled that it has desired physical properties such as molecular weight or viscosity and it has no isocyanate group remaining therein.

The molecular weight of the specific polyurethane resin for use in the present invention is preferably at least 10,000, more preferably from 40,000 to 200,000 in terms of the weight-average molecular weight thereof. If the weight-average molecular weight of the resin is no more than 40,000, the resin film strength will be poor; but if more than 200,000, the non-image area of the resin film could not be sufficiently removed when processed with an alkaline developer.

One or more different types of the specific polyurethane resin may be used herein either singly or in combination. The polyurethane resin may be combined with any other polymer compound (for example, polyurethane resins and alkali-soluble polymers mentioned below) so long as it does not interfere with the effect of the present invention. In this case, the additional polymer compound preferably accounts for no more than 90% by weight, more preferably no more than 60% by weight of all the polymer compounds which comprise the specific polyurethane resin used herein.

The specific polyurethane resin content of the image-recording material of the present invention is from about 10 to 95% by weight, preferably from about 30 to 85% by weight in terms of the solid content thereof. If the specific polyurethane resin content is smaller than 10% by weight, the strength of the image area of the image-recorded material will be low; but if larger than 95% by weight, no image can be formed on the material.

For the specific polyurethane resin for use in the present invention, those having an unsaturated group in the principle chain and/or the side-chain branches of the polymer structure are preferable. Having an unsaturated group in the principle chain and/or the side-chain branches of the polymer structure, the resins of the type crosslink with polymerizable compounds or with each other to a higher degree, and the strength of the photo-cured product increases. Accordingly, when planographic printing plate precursors contain the specific polyurethane resin of the type, they produce printing plates of better printing durability. Preferably, the unsaturated group has a carbon-carbon double bond to facilitate the intended crosslinking reaction.

An unsaturated group into the polymer terminal may be introduced, for example, as follows. In the above-mentioned process of producing the polyurethane resin, the isocyanate group remaining in the polymer terminal is processed with an unsaturated group-having alcohol or amine. Specifically, those mentioned hereinabove for the unsaturated group-having, monofunctional alcohol or monofunctional amine compound are used for processing the polymer terminal.

To introduce an unsaturated group into the principle chain of the polymer structure, for example, used is a diol compound having an unsaturated group in the direction of the principle chain of the polymer structure is used in producing the polyurethane resin. Specifically, the diol compound having an unsaturated group in the direction of the principle chain of the polymer structure are:

cis-2-butene-1,4-diol, trans-2-butene-1,4-diol, and polybutadiene-diol.

In the present invention, the specific polyurethane resin may be combined with an alkali-soluble polymer including polyurethane resins having molecular structures that differ from the specific polyurethane resin. For example, the specific polyurethane resin may be combined with a polyurethane resin having an aromatic group in the principle chain and/or the side-chain branches.

In addition, the specific polyurethane resin for use in the present invention may be combined with a binder resin such as those described in Japanese Patent Application No. 2000-273429, paragraphs [0077] to [0081].

<(B) Photo-thermal Converting Agent>

Since the image-recording material of the present invention is imagewise processed through heat-mode exposure typically by an IR laser, a photo-thermal converting agent is indispensable therein. The photo-thermal converting agent has the function of absorbing light in a predetermined wavelength range to convert it into heat. By the heat thus generated, the component (C) mentioned below (this is a compound capable of generating a radical through heat-mode exposure to light that can be absorbed by the photo-thermal converting agent (B)) is decomposed to generate a radical.

The photo-thermal converting agent of the present invention may be any which has the function of converting the light which it has absorbed into heat. IR-absorbing dyes and pigments that have an absorption peak in the wavelength range of the IR laser used for image formation, for example, in a wavelength range from 760 nm to 1200 nm, are generally used.

The dyes may be any commercially-available ones and any other known dyes, for example, those described in *Dye Handbook* (by the Association of Organic Synthetic Chemistry of Japan, 1970). Specifically, they are azo dyes, metal-complex azo dyes, pyrazolonazo dyes, naphthoquinone dyes, anthraquinone dyes, phthalocyanine dyes, carbonium dyes, quinonimine dyes, methine dyes, cyanine dyes, squarylium dyes, pyrylium salts, and metal thiolate complexes.

Preferred dyes for use herein are cyanine dyes such as those described in Nos. JP-A 58-125246, 59-84356, 59-202829 and 60-78787; methine dyes in JP-A Nos. 58-173696, 58-181690 and 58-194595; naphthoquinone dyes in JP-A Nos. 58-112793, 58-224793, 59-48187, 59-73996, 60-52940 and 60-63744; squarylium dyes in JP-A No.58-112792; and cyanine dyes in BP No.434,875.

Also preferred for use herein are near-IR absorbing sensitizers such as those described in U.S. Pat. No. 5,156,938; substituted arylbenzo(thio)pyrylium salts in U.S. Pat. No. 3,881,924; trimethine-thiapyrylium salts in JP-A No. 57-142645 (U.S. Pat. No. 4,327,169); pyrylium compounds in JP-A Nos. 58-181051, 58-220143, 59-41363, 59-84248, 59-84249, 59-146063 and 59-146061; cyanine dyes in JP-A No. 59-216146; pentamethine-thiopyrylium salts in U.S. Pat. No. 4,283,475; and pyrylium compounds in JP-B Nos. 5-13514 and 5-19702.

Other examples preferred for the dyes for use herein are near-IR absorbing dyes of formulae (I) and (II) in U.S. Pat. No. 4,756,993.

Of those dyes, especially preferable are cyanine dyes, squarylium dyes, pyrylium salts, and nickel-thiolate complexes. More preferable are cyanine dyes, and most preferable are those of the following general formula (I).

General formula (I)

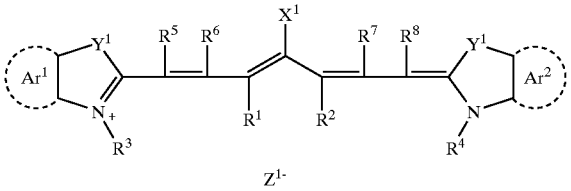

In formula (I), $X^1$ represents a halogen atom, or $X^2$—$L^1$. In this, $X^2$ represents an oxygen or sulfur atom; $L^1$ represents a hydrocarbon group having from 1 to 12 carbon atoms. $R^1$ and $R^2$ each independently represents a hydrocarbon group having from 1 to 12 carbon atoms. In view of the storage stability of the coating liquid for the recording layer containing the dye, $R^1$ and $R^2$ each are preferably a hydrocarbon group having at least 2 carbon atoms; more preferably, $R^1$ and $R^2$ are bonded to each other to form a 5-membered or 6-membered ring.

$Ar^1$ and $Ar^2$ may be the same or different, and each represents an optionally-substituted aromatic hydrocarbon group. Preferably, the aromatic hydrocarbon group for them is a benzene ring or a naphthalene ring. Preferable substituents for them are a hydrocarbon group having at most 12 carbon atoms, a halogen atom, and an alkoxy group having at most 12 carbon atoms. $Y^1$ and $Y^2$ may be the same or different, and each represents a sulfur atom, or a dialkylmethylene group having at most 12 carbon atoms. $R^3$ and $R^4$ may be the same or different, and each represents an optionally-substituted hydrocarbon group having at most 20 carbon atoms. Preferable substituents for them are an alkoxy group having at most 12 carbon atoms, a carboxyl group, and a sulfo group. $R^5$, $R^6$, $R^7$ and $R^8$ may be the same or different, and each represents a hydrogen atom, or a hydrocarbon group having at most 12 carbon atoms. Preferably, these are hydrogen atoms, as the starting materials for the dyes are easily available. $Z^{1-}$ represents a counter anion. However, in case where any of $R^1$ to $R^8$ is substituted with a sulfo group, $Z^{1-}$ is unnecessary. In view of the storage stability of the coating liquid for the recording layer containing the dye, $Z^{1-}$ is preferably a halide ion, a perchlorate ion, a tetrafluoroborate ion, a hexafluorophosphate ion, or a sulfonate ion, more preferably a perchlorate ion, a hexafluorophosphate ion or an arylsulfonate ion.

Examples of the cyanine dyes of formula (I) preferred for use in the present invention are those described in Japanese Patent Application No. 11-310623, paragraphs [0017] to [0019].

The pigments for use in the present invention may be any commercially-available or other known pigments, for example, those described in *Color Index* (C.I.) *Handbook, Latest Pigment Handbook* (by the Pigment Technology Association of Japan, 1977); *Latest Pigment Application Technology* (by CMC, 1986); and *Printing Ink Technology* (by CMC, 1984).

Various types of pigments are usable herein, including, for example, black pigments, yellow pigments, orange pigments, brown pigments, red pigments, violet pigments, blue pigments, green pigments, fluorescent pigments, metal powder pigments, and other polymer-bonded pigments. Specifically, they include insoluble azo pigments, azo-lake pigments, condensed azo pigments, chelate-azo pigments, phthalocyanine pigments, anthraquinone pigments, perylene and perinone pigments, thioindigo pigments, quinacridone pigments, dioxazine pigments, isoindolinone pigments, quinophthalone pigments, dyed lake pigments, azine pigments, nitroso pigments, nitro pigments, natural pigments, fluorescent pigments, inorganic pigments, and carbon black. Of those, carbon black is preferable.

These pigments may be used with or without being surface-treated. The surface treatment for these include a method of coating their surfaces with resin or wax; a method of adhering surfactant thereto; a method of bonding a reactive substance (e.g., silane coupling agent, epoxy compound, polyisocyanate) to their surfaces. The methods of surface treatment are described in *Properties and Applications of Metal Soap* (by Miyuki Publishing); *Printing Ink Technology* (by CMC, 1984); and *Latest Pigment Application Technology* (by CMC, 1986).

The particle size of the pigment for use herein is preferably from 0.01 μm to 10 μm, more preferably from 0.05 μm to 1 μm, even more preferably from 0.1 μm to 1 μm. If its particle size is less than 0.01 μm, the pigment dispersion will be unstable in the coating liquid for the image-recording layer; but if more than 10 μm, the pigment dispersion will interfere with the uniformity of the image-recording layer.

For dispersing the pigment, any known dispersion technique for ordinary ink production or toner production in the art may be used. The dispersing machine for the pigment includes, for example, ultrasonic dispersers, sand mills, attritors, pearl mills, super mills, ball mills, impellers, dispersers, KD mills, colloid mills, dynatrons, three-roll mills, pressure kneaders. The details of pigment dispersion are described in *Latest Pigment Application Technology* (by CMC, 1986).

The photo-thermal converting agent may be added to one and the same layer of the recording material, along with the other components therein; or it may be in a separate layer of the material. Preferably, during the preparation of the negative image-forming material, the recording layer of the recording that contains the photo-thermal converting agent is designed so that its optical density is from 0.1 to 3.0 at the absorption peak in a wavelength range of from 760 nm to 1200 nm. If the optical density of the recording layer oversteps the range, the sensitivity thereof will be low. The optical density is determined based on the amount of the photo-thermal converting agent in the recording layer and the thickness of the layer. Therefore, the desired optical density of the recording layer may be attained by controlling the condition of the two. The optical density of the recording layer may be measured in any ordinary manner. For example, a recording layer of which the dry thickness is suitably controlled so that it satisfies the requirement for planographic printing plates is formed on a transparent or white support, and its optical density is measured with an optical transmission densitometer; or this recording layer is formed on a reflective support of, for example, aluminium, and the reflection density of the layer is measured.

<(C) Radical-generating Compound>

The compound that generates a radical through heat-mode exposure to light is combined with the photo-thermal converting agent (B) mentioned above. When exposed to light that can be absorbed by the photo-thermal converting agent, for example, to IR laser, the compound receives optical and/or thermal energy, and generates a radial, thereby initiating and promoting the polymerization of a polymerizing unsaturated group-having radical-polymerizing compound (D). Here, the meaning of the "heat-mode exposure", is the same as the aforementioned definition.

The radical initiator for use in the present invention may be selected from known photopolymerization initiators and thermal polymerization initiators. For example, it includes onium salts, trihalomethyl group-having triazine compounds, peroxides, azo-type polymerization initiators, azide compounds, and quinonediazide compounds. Onium salts are preferable for having high sensitivity.

Onium salts are preferable for the radical-generating compound for use in the present invention, including, for example, iodonium salts, diazonium salts and sulfonium slats. The onium salts have the function of additionally acting as an acid generator. However, when combined with a radical-polymerizing compound mentioned below, they function as a radical polymerization initiator. Preferable onium salts for use in the present invention are those represented by the following general formulae (III) to (V):

General formula (III)

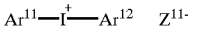

$Ar^{11}—\overset{+}{I}—Ar^{12}$ $Z^{11-}$

General formula (IV)

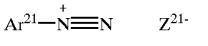

$Ar^{21}—\overset{+}{N}\equiv N$ $Z^{21-}$

General formula (V)

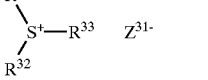

$R^{31}$, $R^{32}$, $S^{+}—R^{33}$ $Z^{31-}$

In formula (III), $Ar^{11}$ and $Ar^{12}$ each independently represents an optionally-substituted aryl group having at most 20 carbon atoms. Preferable examples of the substituents for the substituted aryl group are a halogen atom, a nitro group, an alkyl group having at most 12 carbon atoms, an alkoxy group having at most 12 carbon atoms, and an aryloxy group having at most 12 carbon atoms. $Z^{11-}$ represents a counter ion selected from the group consisting of halide ions, perchlorate ions, carboxlate ions, tetrafluoroborate ions, hexafluorophosphate ions and sulfonate ions, and is preferably any of perchlorate ions, hexafluorophosphate ions and arylsulfonate ions.

In formula (IV), $Ar^{21}$ represents an optionally-substituted aryl group having at most 20 carbon atoms. Preferable substituents therefor are a halogen atom, a nitro group, an alkyl group having at most 12 carbon atoms, an alkoxy group having at most 12 carbon atoms, an aryloxy group having at most 12 carbon atoms, an alkylamino group having at most 12 carbon atoms, a dialkylamino group having at most 12 carbon atoms, an arylamino group having at most 12 carbon atoms, and a diarylamino group having at most 12 carbon atoms. $Z^{21-}$ has the same meaning as $Z^{11-}$, representing a counter ion.

In formula (V), $R^{31}$, $R^{32}$ and $R^{33}$ may be the same or different, and each represents an optionally-substituted hydrocarbon group having at most 20 carbon atoms. Preferable substituents therefor are a halogen atom, a nitro group, an alkyl group having at most 12 carbon atoms, an alkoxy group having at most 12 carbon atoms, and an aryloxy group having at most 12 carbon atoms. $Z^{31-}$ has the same meaning as $Z^{11-}$, representing a counter ion.

Preferable examples of the onium salts for use in the present invention are described, for example, in the applicant's own prior patent applications, Japanese Patent Application No. 11-310623, paragraphs [0030] to [0033] and Japanese Patent Application No. 2000-160323, paragraphs [0015] to [0046].

Preferably, the onium salt for use in the present invention has a peak absorption wavelength of not longer than 400 nm, more preferably not longer than 360 nm. As the radical generator, onium salt therein has the absorption wavelength in the UV range, the image-recording material of the present invention can be handled even under white light in processing planographic printing plate precursors having it.

The onium salt in the recording layer may be in an amount of from 0.1% to 50% by weight, preferably from 0.5% to 30% by weight, more preferably from 1% to 20% by weight of the total solid content of the coating liquid for the recording layer. If the amount of the onium salt therein is smaller than 0.1% by weight, the sensitivity of the recording layer will be low; but if larger than 50% by weight, the non-image area of printed matters will be stained. One or more such onium slats may be in the recording material either singly or in combination. If desired, the onium salt may be added to one and the same recording layer of the material along with the other components; or it may be in a separate layer, and the layer containing the onium salt may be combined with other layers.

<(D) Radical-polymerizing Compound>

The image-recording material of the present invention may contain a radical-polymerizing compound. The radical-polymerizing compound has at least one ethylenic unsaturated double bond, and is selected from compounds having at least one, preferably at least two terminal ethylenic unsaturated bonds. The compounds are well known in the art, and any of them are usable herein with no specific limitations. They have various chemical forms, including, for example, monomers, prepolymers (e.g., dimers, trimers, oligomers), and their mixtures and copolymers.

Examples of monomers and their copolymers are unsaturated carboxylic acids (e.g., acrylic acid, methacrylic acid, itaconic acid, crotonic acid, isocrotonic acid, maleic acid), and their esters and amides. Esters of unsaturated carboxylic acids with aliphatic polyalcohols; and amides of unsaturated carboxylic acids with aliphatic polyamines are preferable. Also adducts of unsaturated carboxylates or amides having a nucleophilic substituent of, for example, hydroxyl, amino or mercapto groups, with monofunctional or polyfunctional isocyanates or epoxides; and dehydrated condensates thereof with monofunctional or polyfunctional carboxylic acids are preferable.

Adducts of unsaturated carboxylates or amides having an electrophilic substituent of, for example, isocyanate or epoxy groups, with monofunctional or polyfunctional alcohols, amines or thiols; and substituting reaction products of unsaturated carboxylates or amides having a leaving substituent of, for example, halogens or tosyloxy groups, with monofunctional or polyfunctional alcohols, amines or thiols are also preferable. Other groups of compounds, for which unsaturated phosphonic acids or styrenes are used in place of the unsaturated carboxylic acids are usable herein.

Examples of esters of aliphatic polyalcohols with unsaturated carboxylic acids for the radical-polymerizing compound for use herein are mentioned below. Acrylates for it include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl) ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri (acryloyloxyethyl) isocyanurate, polyester acrylate oligomers.

Methacrylates include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2hydroxypropoxy)phenyl]dimethylmethane, bis-[p-(methacryloxyethoxy)phenyl]dimethylmethane.

Itaconates include ethylene glycol diitaconate, propylene glycol diitaconate, 1,3-butanediol diitaconate, 1,4-butanediol diitaconate, tetramethylene glycol diitaconate, pentaerythritol diitaconate, sorbitol tetraitaconate.

Crotonates include ethylene glycol dicrotonate, tetramethylene glycol dicrotonate, pentaerythritol dicrotonate, sorbitol tetra-dicrotonate.

Isocrotonates include ethylene glycol diisocrotonate, pentaerythritol diisocrotonate, sorbitol tetraisocrotonate.

Maleates include ethylene glycol dimaleate, triethylene glycol dimaleate, pentaerythritol dimaleate, sorbitol tetramaleate.

Other esters also preferred for use herein are, for example, aliphatic alcohol esters such as those described in JP-B Nos. 46-27926 and 51-47334 and JP-A No. 57-196231; aromatic skeleton as in JP-A Nos. 59-5240, 59-5241 and 2-226149; and amino-having esters as in JP-A No. 1-165613.

Examples of amide monomers of aliphatic polyamines and unsaturated carboxylic acids preferred for use herein are methylenebis-acrylamide, methylenebis-methacrylamide, 1,6-hexamethylenebis-acrylamide, 1,6-hexamethylenebis-methacrylamide, diethylenetriamine-trisacrylamide, xylylenebis-acrylamide, and xylylenebis-methacrylamide.

Other amide monomers having a cyclohexylene structure, as in JP-B 54-21726, are also preferred for use herein.

Urethane polyadducts obtained through addition reaction of isocyanates with hydroxyl compounds are preferable. Examples thereof are vinylurethanes having at least two polymerizing vinyl groups in one molecule, which are produced through addition reaction of polyisocyanate compounds having at least two isocyanate groups in one molecule with hydroxyl-having vinyl monomers of the following general formula (23), for example, as in JP-B 48-41708.

$$CH_2{=}C(R^{32})COOCH_2CH(R^{33})OH \quad (23)$$

wherein $R^{32}$ and $R^{33}$ each independently represents a hydrogen atom or a methyl group.

Urethane acrylates such as those described in JP-A No. 51-37193, and JP-B Nos. 2-32293 and 2-16765; and ethylene oxide skeleton-having urethane compounds as in JP-B Nos. 58-49860, 56-17654, 62-39417 and 62-39418, are also preferred for use herein.

Radical-polymerizing compounds having an amino structure or sulfido structure in the molecule, such as those described in JP-A Nos. 63-277653, 63-260909 63-260909 and 1-105238, are also usable herein.

Other usable examples are polyfunctional acrylates and methacrylates such as polyester acrylates, and epoxy acrylates produced through reaction of epoxy resins with (meth) acrylic acids, for example, as in JP-A No. 48-64183, and JP-B Nos. 49-43191 and 52-30490. Also usable are specific unsaturated compounds as in JP-B Nos. 46-43946, 1-40337 and 1-40336; and vinylphosphonic acids as in JP-A No. 2-25493. In certain cases, perfluoroalkyl-having compounds such as those described in JP-A No. 61-22048 are preferable. Also photo-curable monomers and oligomers disclosed in *the Journal of the Adhesive Association of Japan*, Vol. 20, No. 7. pp. 300–308 (1984) are usable.

One or more such radical-polymerizing compounds may be used herein either singly or in combination. The details of the use of these radical-polymerizing compounds in the present invention, including what type of the compound is used, whether the compounds are used either singly or in combination, and how much of the compound is added to the recording material, may be determined in accordance with the plan of the performance of the final recording material of the present invention.

In general, the blend ratio of the radical-polymerizing compound in the image-recording material is preferably larger for higher sensitivity of the material. However, if too large, problems occur in that unfavorable phase separation will occur in the coating liquid for the image-recording layer, the layer will be sticky and will interfere with smooth production of the recording material (for example, the components of the recording layer will transfer and adhere to unintended areas), and insoluble solids will be deposited in developers. In view of these, the preferred blend ratio of the radical-polymerizing compound in the recording material of the present invention will be from 5% to 80% by weight, more preferably from 20% to 75% by weight of all the components of the material.

In case where the specific polyurethane resin (A) is combined with the radical-polymerizing compound (D) in the recording material of the present invention, the ratio of the component (A) to the component (D) is from 1:0.05 to 1:3, but preferably from 1:0.1 to 1:2, and more preferably from 1:0.3 to 1:1.5 by weight.

Regarding the method of using the radical-polymerizing compounds in the material, the structure, the blend ratio and the amount of the compounds to be in the material may be suitably selected depending on the degree of polymerization retardation of the compound by oxygen, the resolution of the recording layer containing the compound, the fogging resistance thereof, the refractive index change thereof and the surface adhesiveness thereof. As the case may be, overcoat layers or undercoat layers may be disposed on or below the recording layer in any desired manner.

<Other Components>

In addition to the components mentioned above, various compounds may be optionally added to the image-recording material of the present invention. For example, dyes having a great absorption in the visible light range may be added thereto, serving as colorants for images. Specifically, the dyes are Oil Yellow #101, Oil Yellow #103, Oil Pink #312, Oil Green BG, Oil Blue BOS, Oil Blue #603, Oil Black BY, Oil Black BS, Oil Black T-505 (these are products of Orient Chemical Industry); Victoria Pure Blue, Crystal Violet (CI 42555), Methyl Violet (CI 42535), Ethyl Violet, Rhodamine B (CI 145170B), Malachite Green (CI 42000), Methylene Blue (CI 52015); and dyes described in JP-A 62-293247. Pigments such as phthalocyanine pigments, azo pigments, carbon black and titanium oxide are also preferred for colorants to be in the recording material.

Adding the colorant to the image-recording material is preferred, as facilitating the differentiation of the image area from the non-image area of the processed material. The amount of the colorant to be in the material may be from 0.01% to 10% by weight of the total solid content of the coating liquid for the recording layer.

Preferably, a small amount of a thermal polymerization inhibitor is added to the image-recording material for preventing unnecessary thermal polymerization of the radical-polymerizing compound in the material while the material is produced or stored. Examples of the thermal polymerization inhibitor are hydroquinone, p-methoxyphenol, di-t-butyl-p-cresol, pyrogallol, t-butylcatechol, benzoquinone, 4,4'-thiobis(3-methyl-6-t-butylphenol), 2,2'-methylenebis(4-methyl-6-t-butylphenol), and N-nitroso-N-phenylhydroxylamine aluminium salt. Preferably, the amount of the thermal polymerization inhibitor to be in the material is from about 0.01% by weight to about 5% by weight of all the coating compositions. If desired, a higher fatty acid or its derivative such as behenic acid or benenic acid amide having the ability to prevent polymerization inhibition by oxygen may be added to the recording material. In the step of drying the coated material, the acid or acid derivative added thereto may be localized in the surface of the recording layer. Preferably, the amount of the higher fatty acid or its derivative in the recording material is from about 0.1% by weight to about 10% by weight of all the coating compositions.

One essential use of the image-recording material of the present invention is for forming the image-recording layer of planographic printing plate precursors. For ensuring stable development of the image-recording layer of the material in various conditions, surfactant is optionally added to the material. The surfactant includes, for example, nonionic surfactant as in JP-A Nos. 62-251740 and 3-208514, and ampholytic surfactant as in JP-A Nos. 59-121044 and 4-13149.

Examples of the nonionic surfactant are sorbitan tristearate, sorbitan monopalmitate, sorbitan trioleate, stearic acid monoglyceride, and polyoxyethylene nonylphenyl ether.

Examples of the ampholytic surfactant are alkyl-di(aminoethyl)glycines, alkyl-polyaminoethylglycine hydrochlorides, 2-alkyl-N-carboxyethyl-N-hydroxyethylimidazolinium betaines, and N-tetradecyl-N,N-betaines (e.g., AMOGEN K, trade name by Dai-ichi Kogyo).

The amount of the nonionic surfactant or ampholytic surfactant to be in the image-recording material preferably is from 0.05% to 15% by weight, more preferably from 0.1 to 5% by weight of the coating liquid for the recording layer.

Also if desired, the coating liquid for the recording layer of the image-recording material of the present invention may contain plasticizer for softening the coating film of the material. The plasticizer includes, for example, polyethylene glycol, tributyl citrate, diethyl phthalate, dibutyl phthalate, dihexyl phthalate, dioctyl phthalate, tricresyl phosphate, tributyl phosphate, trioctyl phosphate, and tetrahydrofurfuryl oleate.

For fabricating planographic printing plate precursors that comprise the image-recording material of the present invention, in general, the above-mentioned components of the image-recording material are dissolved in a solvent along with other necessary components, and applied to a suitable support. The solvent includes, for example, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulforane, γ-butyrolactone, toluene and water, which, however, are not limiting. These solvents may be used either singly or as combined. Preferably, the concentration of the constituent components (in terms of the total solid content including additives) in the solvent is from 1% to 50% by weight.

The amount (solid content) of the image-recording layer formed and dried on the support varies, depending on the use of the recording material, but, in general, it is preferably from 0.5 $g/m^2$ to 5.0 $g/m^2$ for planographic printing plate precursors. For applying the coating liquid to supports, various coating methods are employed. For example, employable is any of bar coating, spin coating, spraying, curtain coating, dipping, air-knife coating, blade coating, or roll coating. With the decrease in the amount of the coating liquid, the apparent sensitivity of the image-recording layer formed increases, but the film strength of the layer decreases.

For improving the coatability of the coating liquid for the image-recording layer, surfactant, for example, fluorine-containing surfactant as in JP-A No. 62-170950 may be added to the coating liquid. Preferably, the amount of the surfactant to be added is from 0.01 to 1% by weight, more preferably from 0.05 to 0.5% by weight of the total solid content of the coating liquid for the recording layer.

One essential use of the image-recording material of the present invention is to form the image-recording layer of planographic printing plate precursors. The planographic printing plate precursor comprises at least a support and a recording layer, optionally having a protective layer. The support and the protective layer that constitute the planographic printing plate precursor are described below.

<Support>

The support to be used in fabricating the planographic printing plate precursors that comprise the image-recording material of the present invention is not specifically defined, so far as it is tabular and has good dimensional stability. For example, it includes paper; paper laminated with a plastic material (e.g., polyethylene, polypropylene, polystyrene); metal sheets (of, for example, aluminium, zinc or copper); plastic films (of, for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, or polyvinyl acetal). These may be in any form of single-component sheets of, for example, resin films or metal sheets, or laminates of two or more components. The laminates include, for example, paper or plastic film laminates coated with metal as above through lamination or deposition, and laminate sheets of different types of plastic films.

For the support for use herein, polyester films or aluminium sheets are preferable. Especially preferable are aluminium sheets for having good dimensional stability and as being relatively inexpensive. Preferably, the aluminium sheets for use herein are of pure aluminium or an aluminium alloy consisting essentially of aluminium and containing minor amount of hetero elements. Aluminium-laminated or deposited plastic films are also usable herein. The hetero elements to be in the aluminium alloy include, for example, silicon, iron, manganese, copper, magnesium, chromium, zinc, bismuth, nickel and titanium. The hetero element content of the aluminium alloy is at most, 10% by weight. Especially preferable for use in the present invention are pure aluminium sheets. However, completely pure aluminium is difficult to prepare in an ordinary smelting technique. Therefore, the pure aluminium for use herein may contain negligible amount of hetero elements. The composition of the aluminium sheets for use in the present invention are not specifically defined, and any known aluminium sheets which have heretofore been used in the art may be used in the present invention.

The thickness of the aluminium sheet for use herein may be from about 0.1 mm to 0.6 mm, preferably from 0.15 mm to 0.4 mm, more preferably from 0.2 mm to 0.3 mm.

Prior to roughening the aluminium sheet, if desired, the surface of the aluminium sheet for use herein may be optionally degreased, for example, by treating it with a surfactant, an organic solvent or an alkaline aqueous solution for removing the rolling oil from it.

The surface of the aluminium sheet may be roughened in various methods. For example, it may be mechanically roughened, or may be roughened through electrochemical surface dissolution or through selective chemical dissolution. For mechanically roughening the aluminium sheet, any known method is employable. For example, the surface of the aluminium sheet may be roughened by ball grinding, brushing, blasting, or buffing methods. For electrochemically roughening it, for example, the aluminium sheet may be processed in an electrolytic solution of hydrochloric acid or nitric acid with a direct current or an alternating current being applied thereto. The two methods may be combined, if desired, as in JP-A No. 54-63902.

If desired, the thus-roughened aluminium sheet may be etched with alkali and neutralized, and then optionally subjected to anodic oxidation for further enhancing the water retentiveness and the wear resistance of its surface. For anodic oxidation of the aluminium sheet, various types of electrolytes capable of forming porous oxide films are employable. Generally employed herein is sulfuric acid, phosphoric acid, oxalic acid, chromic acid or a mixture thereof. The concentration of the electrolyte in anodic oxidation may be determined, depending on the type of the electrolyte used.

The condition for anodic oxidation varies, depending on the type of the electrolyte used, and therefore could not be specified indiscriminately. In general, however, the electrolyte concentration of the processing solution may be from 1% to 80% by weight; the temperature of the processing solution may be from 5° C. to 70° C.; the current density may be from 5 A/dm$^2$ to 60 A/dm$^2$; the voltage may be from 1 V to 100 V; and the time for electrolysis may be from 10 seconds to 5 minutes.

The amount of the oxide film to be formed through such anodic oxidation is preferably at least 1.0 g/m$^2$, more preferably from 2.0 g/m$^2$ to 6.0 g/m$^2$. If the oxide films less than 1.0 g/m$^2$, it is unsatisfactory for a desired printing durability, and the non-image area of planographic printing plates will be easily scratched. Ink adheres to the scratched part of the printing plate and the prints obtained will often be stained.

The anodic oxidation is applied to the printing face of the support of planographic printing plates. In general, however, even the back of the support receives the line of electric force and will therefore undergo anodic oxidation to form an oxide film of from 0.01 g/m$^2$ to 3 g/m$^2$ thereon.

After having been subjected to anodic oxidation, the surface of the aluminium sheet is optionally hydrophilicated. As a hydrophilicating treatment, for example, a method of processing the aluminium sheet with an alkali metal silicate (e.g., aqueous sodium silicate solution), as in U.S. Pat. Nos. 2,714,066, 3,181,461, 3,280,734 and 3,902,734 can be employed. In this method, the support is dipped in a sodium silicate aqueous solution or is electrolyzed in the solution. In addition, a method of processing the aluminium sheet with potassium fluorozirconate, as in JP-B No. 36-22063; or a method of processing it with polyvinylphosphonic acid, as in U.S. Pat. Nos. 3,276,868, 4,153,461 and 4,689,272 are also employable.

Of those, preferred is the method of hydrophilicating with silicate. The method is described below.

The aluminium sheet having been subjected to anodic oxidation in the manner as above to form an oxide film thereon is dipped, for example, at 15 to 80° C. for 0.5 to 120 seconds, in an alkaline metal silicate aqueous solution which has a n alkaline metal silicate concentration of from 0.1 to 30% by weight, preferably from 0.5 to 10% by weight and having a pH at 25° C. of from 10 to 13. If the pH is lower than 10, the alkaline metal silicate aqueous solution will gel; but if the pH is higher than 13, it will dissolve the oxide film. The alkali metal silicate to be used in the method is, for example, sodium silicate, potassium silicate or lithium silicate. A hydroxide may be added to the alkaline metal silicate aqueous solution so as to increase the pH of the solution. The hydroxide is, for example, sodium hydroxide, potassium hydroxide or lithium hydroxide. If desired, an alkaline earth metal salt or a Group IVB metal salt may be added to the processing solution. The alkaline earth metal salt includes, for example, nitrates such as calcium nitrate, strontium nitrate, magnesium nitrate, barium nitrate; and other water-soluble salts such as sulfates, hydrochlorides, phosphates, acetates, oxalates and borates. The Group IVB metal salt includes, for example, titanium tetrachloride, titanium trichloride, potassium titanium fluoride, potassium titanium oxalate, titanium sulfate, titanium tetraiodide, zirconium oxide chloride, zirconium dioxide, zirconium oxychloride, zirconium tetrachloride. One or more such alkaline earth metal salts or Group IVB metal salts may be added to the processing solution, either singly or in combination. The amount of the metal salt in the processing solution preferably is from 0.01 to 10% by weight, more preferably from 0.05 to 5.0% by weight.

The silicate treatment significantly improves the surface hydrophilicity of the aluminium sheet. Therefore, ink hardly adheres to the non-image area of the printing plate that comprises the thus-hydrophilicated aluminium sheet, and the printed matters are stained little.

If desired, the back of the support may be coated with a back coat layer. For the back-coat layer, organic polymer compounds such as those described in JP-A 5-45885; and metal oxides formed by hydrolyzing and polycondensing organic or inorganic metal compounds such as those described in JP-A 6-35174 are preferable.

Among these back-coat layers, which are applied, silicon alkoxides such as $Si(OCH_3)_4$, $Si(OC_2H_5)_4$, $Si(OC_3H_7)_4$, and $Si(OC_4H_9)_4$, are more preferable, for being as inexpensive and easily available. Especially preferable are coat layers of metal oxides derived from them, for being highly resistant to developers.

<Protective Layer>

In case where the image-recording material of the present invention is used in planographic printing plate precursors, it is generally exposed to ambient light. In this case, therefore, it is desirable that the image-recording layer comprising a photopolymerizable composition is covered and protected by a protective layer. The necessary characteristics of the protective layer are that permeation of oxygen and other low-molecular compounds through the layer is low, the light transmission through the protective layer is high, the adhesiveness of the protective layer to the underlying recording layer is good, and the protective layer is readily removed through development after exposure to light. For the protective layer, water-soluble polymer compounds of relatively high crystallinity, such as polyvinyl alcohol, polyvinylpyrrolidone, acidic celluloses, gelatin, gum arabic, polyacrylic acid are generally used.

The specific polyurethane resin that serves as a film-forming resin in the image-recording material of the present invention is characterized in that the dissolved oxygen content of the resin film is low and the oxygen barrier property thereof is good. Therefore, the advantage the image-recording material is that its image formability is lowered little by polymerization inhibition by oxygen and the material does not always require a protective layer such as that mentioned above. However, for further improving the oxygen barrier property of the material and improving the image formability, especially the image strength of the material, the material may be coated with such a protective layer.

<Printing with Planographic Printing Plate Precursors>

A recording layer of the image-recording material of the present invention may be formed on a support such as that mentioned above to fabricate a planographic printing plate precursor. An image can be recorded on the printing plate precursor by exposing it to IR rays from IR laser. In accordance with the case, image recording may also be effected by exposing the precursor to a UV lamp or by thermally processing it with a thermal head. In the present invention, it is preferable that the recording layer is image-wise exposed to IR rays falling within a wavelength range of from 760 nm to 1200 nm from solid laser or semiconductor laser.

After being exposed by an IR layer, the image-recording material of the present invention is preferably developed in water or in the alkaline aqueous solution.

In cases where the image-recording material of the present invention is developed in the alkaline aqueous solution, the developer and the replenisher for the development may be any known alkaline aqueous solutions, for example, inorganic alkali salts such as sodium and potassium silicates, sodium, potassium and ammonium tertiary phosphates, sodium, potassium and ammonium secondary phosphates, sodium, potassium and ammonium carbonates, sodium, potassium and ammonium hydrogencarbonates, sodium, potassium and ammonium borates, and sodium, ammonium, potassium and lithium hydroxides. Organic alkalis such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine are also usable.

One or more of these alkalis may be used either singly or in combination.

When an automatic processor is used, it is known that a replenisher, which is the same as the developer originally in the development tank or is an aqueous solution having a higher alkali concentration than the original developer, is replenished to the development tank. In the processor of this system, a large number of planographic printing plate precursors can be continuously processed even though the developer in the development tank is not exchanged for a long period of time. This replenishing system is favorable to the present invention.

If desired, various surfactants and organic solvents may be added to the developer and the replenisher, for promoting or inhibiting the development, for dispersing development scum, and for enhancing the affinity of the image area of the developed printing plate to ink. For the surfactant, anionic, cationic, nonionic and ampholytic surfactants are preferable. One preferable example of organic solvents for use herein is benzyl alcohol. Polyethylene glycol and its derivatives, and polypropylene glycol and its derivatives are also preferable. If desired, non-reducing sugar such as arabitol, sorbitol or mannitol may be added to the developer and the replenisher.

If desired, hydroquinone, resorcinol, as well as an inorganic salt-type reducing agent such as sulfurous acid or sodium or potassium hydrogensulfite, and an organic carboxylic acid, a defoaming agent and a water softener may also be added to the developer and the replenisher.

After having been processed with a developer and a replenisher such as those mentioned above, the printing plates are post-processed with washing water, a rinsing solution that contains a surfactant, or a fat-desensitizing solution that contains gum arabic or a starch derivative. In cases where the image-recording material of the present invention is used for producing such printing plates, it is, after being processed in the manner as above, post-treated with any of these solutions combined in any desired manner.

In the recent art of plate-making and printing, automatic processors for printing plates are widely used for rationalizing and standardizing the plate-making operation. In general, the automatic processor is composed of a developing zone and a post-processing zone, and comprises a unit for conveying printing plate precursors to be processed therein, and processing solution tanks each equipped with a spraying unit. In this, each exposed plate is conveyed horizontally, and sprayed in order with processing solutions that are pumped up to their spray nozzles, and is thus developed and processed. Apart from this, a different system is known, in which each exposed plate precursor is led in order into tanks filled with respective processing solutions, and guided therein by guide rolls, and is thus developed and processed. In such automatic processors, replenishers may be replenished to the respective processing solutions, depending on the processing speed and the processing time. As the case may be, the replenishment may be automated by monitoring the electroconductivity of each processing solution with a sensor.

A so-called disposable processing system, in which processing is performed using processing liquid which has not yet been used, can also be applied.

The planographic printing plates produced in the above manner as above are optionally coated with a fat-desensitizing gum, and then used in producing prints. For further enhancing their printing durability, they may be optionally burned.

Prior to being burned, it is desirable that the planographic printing plates are treated with a burning conditioner, for example, as in JP-B Nos. 61-2518 and 55-28062, and JP-A Nos. 62-31859 and 61-159655.

For this, for example, the planographic printing plates may be wiped with sponge or absorbent cotton that contains a burning conditioner; or they may be dipped in a burning conditioner put in a vat; or a burning conditioner may be applied thereto with an automatic coater. After having been thus coated with a burning conditioner, the plates are preferably squeezed with a squeegee or a squeezing roller so that they can be uniformly coated with it. This treatment produces better results.

The amount of the burning conditioner to be applied to the plates generally is from 0.03 to 0.8 g/m$^2$ (dry weight).

The planographic printing plates thus having been coated with the surface-dressing agent are, after being optionally dried, heated at a high temperature in a burning processor (for example, Fuji Photo Film's Burning Processor Model BP-1300). The heating temperature and the heating time in this treatment vary, depending on the image-forming components in the plates. In general, it is desirable that the plates are heated at a temperature from 180 to 300° C., for 1 to 20 minutes.

After thus burned, the planographic printing plates are optionally washed with water and gummed in any conventional manner. In cases where they are treated with a burning conditioner that contains a water-soluble polymer compound before they are burned, the treatment of fat-desensitization, for example, the treatment of gumming them may be omitted.

The planographic printing plate, for which obtained by the image-recording material of the present invention and which has been produced through the above process, is set in an offset printer to be used in printing a large number of prints.

EXAMPLES

The present invention is described in more detail with reference to the following Synthetic Examples, Examples and Comparative Examples, which, however, are not intended to restrict the scope of the present invention.

Synthetic Examples

Synthetic Example 1

Production of Polyurethane Resin 1

In a 500-ml three-neck round-bottom flask equipped with a condenser and a stirrer, 8.2 g (0.05 mols) of 2,2-bis (hydroxymethyl)butanoic acid and 13.0 g (0.05 mols) of a diol compound (24) shown below were dissolved in 100 ml of N,N-dimethylacetamide. To this mixture, 25.5 g (0.102 mols) of 4,4-diphenylmethane diisocyanate and 0.1 g of dibutyl tin-dilaurate were added, and the mixture stirred under heat at 100° C. for 8 hours. Then, this mixture was diluted with 100 ml of N,N-dimethylformamide and 200 ml of methyl alcohol, and stirred for 30 minutes. The reaction mixture was poured into 3 liters of water with stirring, and a white polymer was deposited therein. The polymer (polyurethane resin 1 shown in Table 1 below) was taken out through filtration, washed with water and dried in a vacuum. A yield thereof was 37 g.

The molecular weight of the polymer was measured by gel permeation chromatography (GPC). The weight-average molecular weight (based on a standard polystyrene) of the polymer was 95,000. Through titration, the carboxyl content (acid value) of the polymer was measured, and found to be 1.10 meq/g.

Synthetic Example 2

Production of Polyurethane Resin 5

In a 500-ml three-neck round-bottom flask equipped with a condenser and a stirrer, 5.9 g (0.04 mols) of 2,2-bis (hydroxymethyl)butanoic acid and 15.9 g (0.06 mols) of a diol compound (25) shown below were dissolved in 100 ml of N-N,-dimethylacetamide. To this were added 20.4 g (0.082 mols) of 4,4-diphenylmethane diisocyanate, 3.4 g (0.02 mols) of 1.6-hexamethylene diisocyanate and 0.1 g of dibutyl tin-dilaurate, and stirred under heat at 100° C. for 8 hours. Then, this was diluted with 100 ml of N,N-dimethylformamide and 200 ml of methyl alcohol, and stirred for 30 minutes. The reaction mixture was poured into 3 liters of water with stirring, and a white polymer was deposited therein. The polymer (polyurethane resin 5 shown in Table 1 below) was taken out through filtration, washed with water and dried in a vacuum. A yield thereof was 34 g.

The molecular weight of the polymer was measured by gel permeation chromatography (GPC). The weight-average molecular weight (based on a standard polystyrene) of the polymer was 98,000. Through titration, the carboxyl content (acid value) of the polymer was measured, and it found to be 1.18 meq/g.

Synthetic Example 3

Production of Polyurethane Resin 8

In a 500-ml three-neck round-bottom flask equipped with a condenser and a stirrer, 5.4 g (0.04 mols) of 2,2-bis (hydroxymethyl)propionic acid and 15.6 g (0.06 mols) of a diol compound (26) shown below were dissolved in 100 ml of N,N-dimethylacetamide. To this mixture, 21.4 g (0.102 mols) of naphthalene diisocyanate and 0.1 g of dibutyl tin-dilaurate were added, and stirred under heat at 100° C. for 8 hours. Then, the mixture was diluted with 100 ml of N,N-dimethylformamide and 200 ml of methyl alcohol, and stirred for 30 minutes. The reaction mixture was poured into 3 liters of water with stirring, and a white polymer was deposited therein. The polymer (polyurethane resin 8 shown in Table 2 below) was taken out through filtration, washed with water and dried in a vacuum. A yield thereof was 34 g.

The molecular weight of the polymer was measured by gel permeation chromatography (GPC). The weight-average molecular weight (based on a standard polystyrene) of the polymer was 79,000. Through titration, the carboxyl content (acid value) of the polymer was measured, and found to be 1.32 meq/g.

The diol compounds used in Examples 1 to 3 are represented by the following formulae (24) to (26), respectively.

(24)

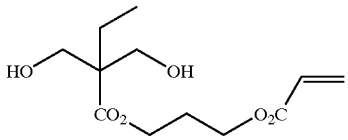

(25)

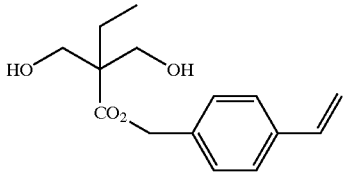

-continued (26)

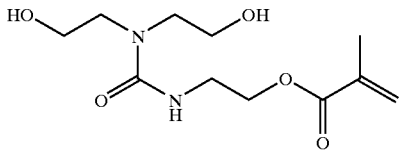

In the same manner as in Synthetic Examples 1 to 3, specific polyurethane resins (polyurethane resin 2 to 4, 6, 7 and 9 to 29) were produced from the diisocyanate compounds and the diol compounds shown in Tables 1 to 5 below. Tables 1 to 5 also shown the data of the molecular weight measured through GPC and the data of the acid value measured through titration of the resins.

TABLE 1

| Polyurethane Resins | Diisocyanate Compounds used (mol %) |
|---|---|
| 1 | 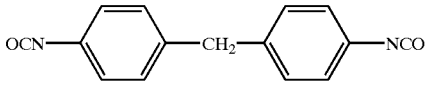 100 |
| 2 | 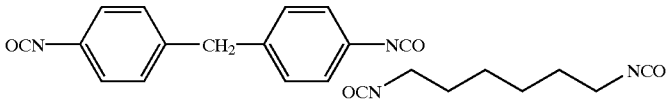 80 20 |
| 3 | 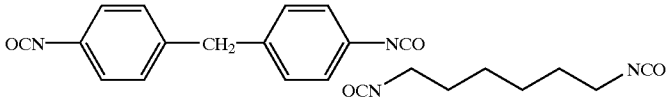 80 20 |
| 4 | 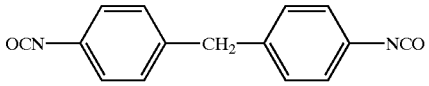 100 |
| 5 | 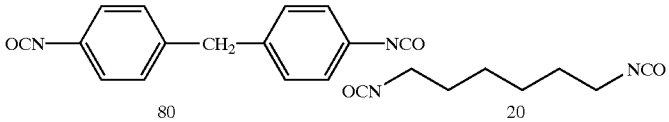 80 20 |
| 6 | 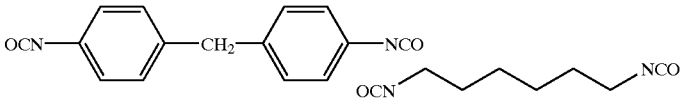 70 30 |

| Polyurethane Resins | Diol Compounds used (mol %) | Weight-Average Molecular Weight | Acid Value (meq/g) |
|---|---|---|---|
| 1 | 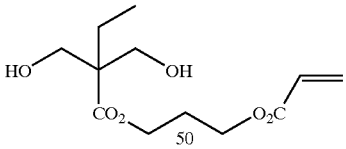 50 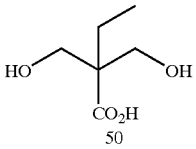 50 | 95,000 | 1.1 |

TABLE 1-continued
| | | | |
|---|---|---|---|
| 2 | 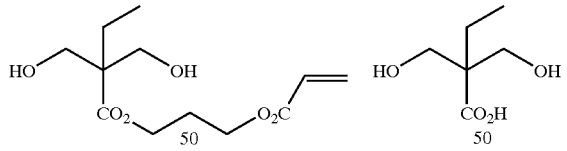 50 50 | 98,000 | 1.18 |
| 3 | 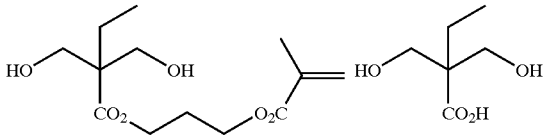 45 55 | 103,000 | 1.33 |
| 4 | 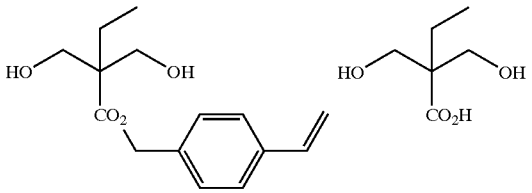 50 55 | 108,000 | 1.05 |
| 5 | 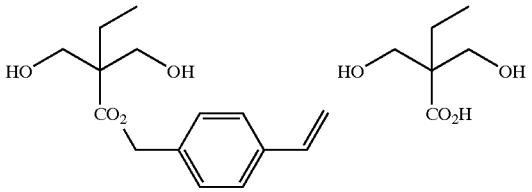 60 40 | 99,000 | 1.11 |
| 6 | 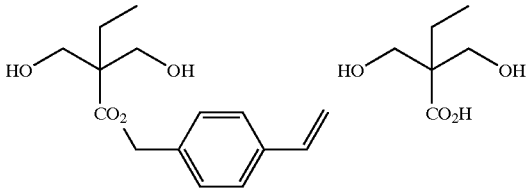 65 35 | 110,000 | 1.21 |
TABLE 2
| Polyurethane Resins | Diisocyanate Compounds used (mol %) |
|---|---|
| 7 | 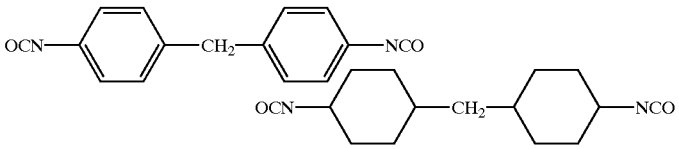 60 40 |
| 8 | 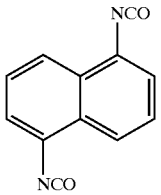 100 |

TABLE 2-continued
| | |
|---|---|
| 9 | 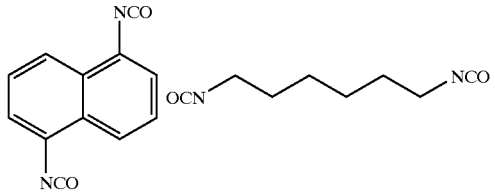 80 20 |
| 10 | 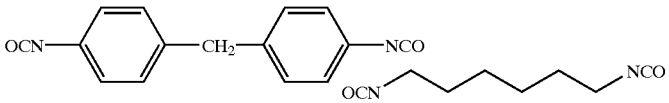 80 20 |
| 11 | 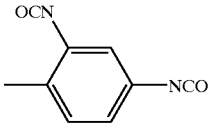 100 |
| 12 | 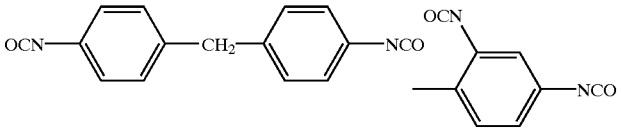 60 40 |
| Polyurethane Resins | Diol Compounds used (mol %) | Weight-Average Molecular Weight | Acid Value (meq/g) |
|---|---|---|---|
| 7 | 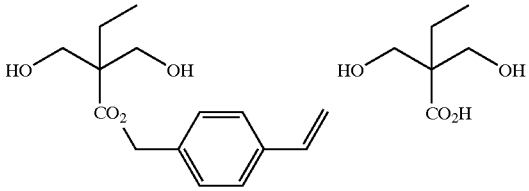 60 40 | 89,000 | 1.3 |
| 8 | 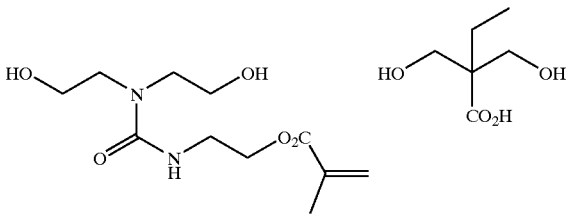 60 40 | 79,000 | 1.32 |
| 9 | 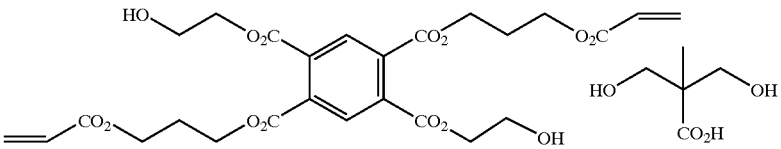 50 50 | 68,000 | 1.39 |

TABLE 2-continued
| | | | |
|---|---|---|---|
| 10 | 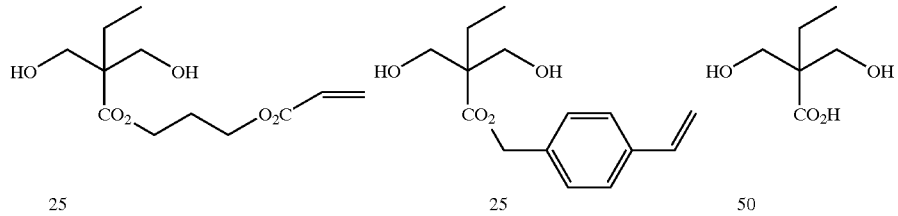 25 25 50 | 96,000 | 1.21 |
| 11 | 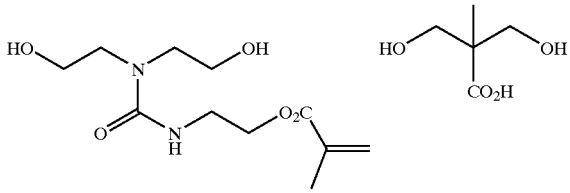 65 35 | 100,000 | 1.39 |
| 12 | 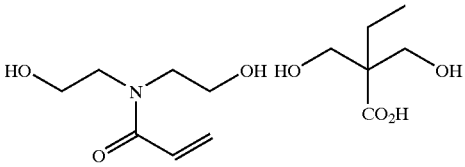 55 45 | 110,000 | 1.4 |
TABLE 3
| Polyurethane Resins | Diisocyanate Compounds used (mol %) |
|---|---|
| 13 | 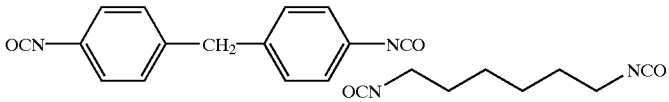 80 20 |
| 14 | 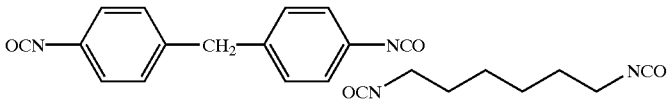 80 20 |
| 15 | 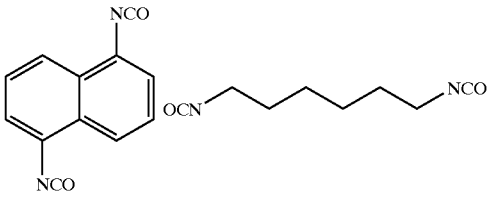 80 20 |
| 16 | 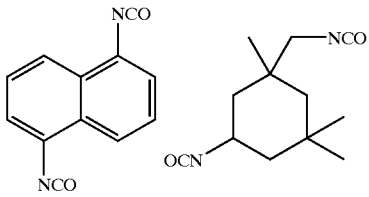 70 30 |

TABLE 3-continued
| | | | | | |
|---|---|---|---|---|---|
| 17 | 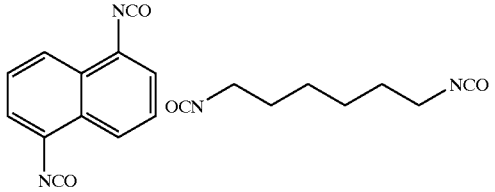 80 | 20 | | | |
| 18 | 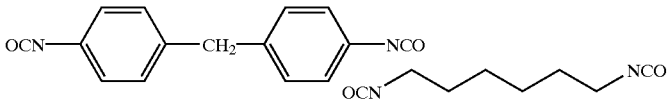 50 | 50 | | | |
| Polyurethane Resins | Diol Compounds used (mol %) | | | Weight-Average Molecular Weight | Acid Value (meq/g) |
| 13 | 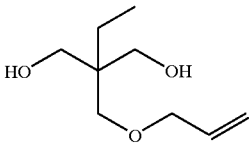 30 | 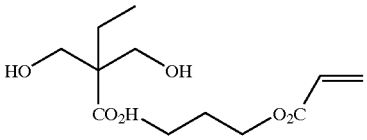 20 | 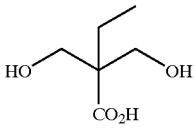 50 | 69,000 | 1.19 |
| 14 | 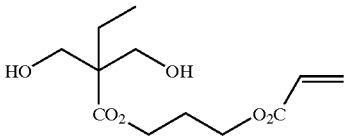 70 | 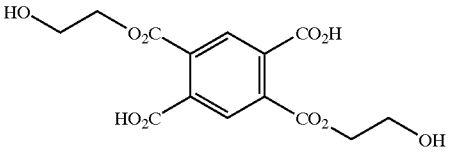 30 | | 120,000 | 1.13 |
| 15 | 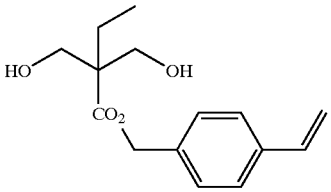 20 | 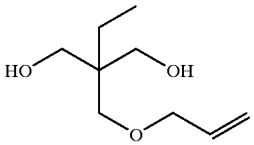 20 | 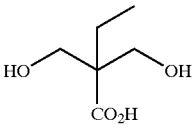 60 | 78,000 | 1.21 |
| 16 | 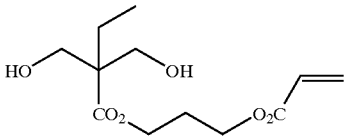 70 | 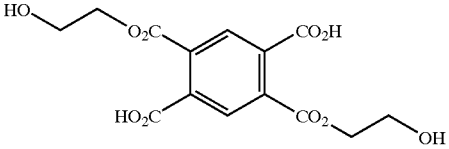 30 | | 81,000 | 1.22 |
| 17 | 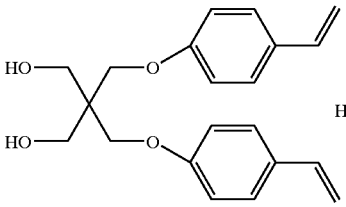 45 | 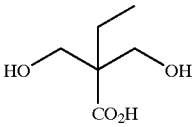 55 | | 103,000 | 1.22 |

TABLE 3-continued
| | | | |
|---|---|---|---|
| 18 | 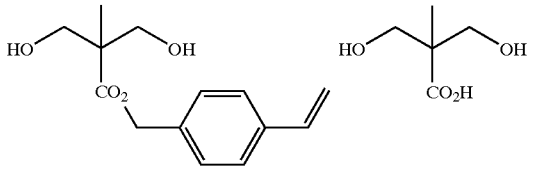 45 55 | 89,000 | 1.35 |
TABLE 4
| Polyurethane Resins | Diisocyanate Compounds used (mol %) |
|---|---|
| 19 | 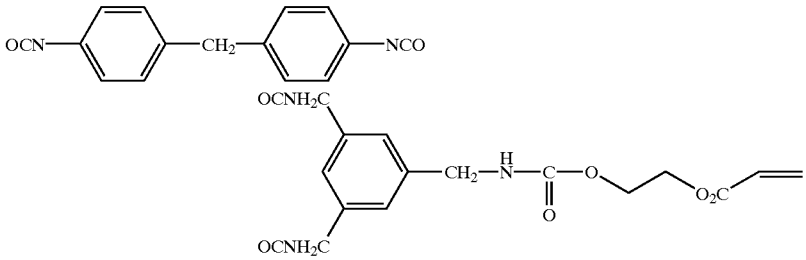 70 30 |
| 20 | 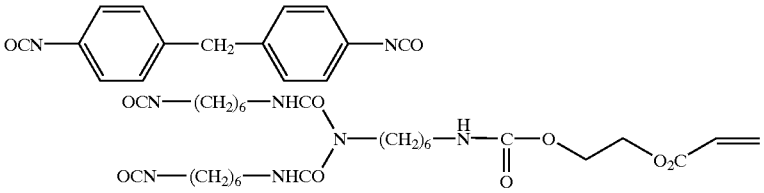 65 35 |
| 21 | 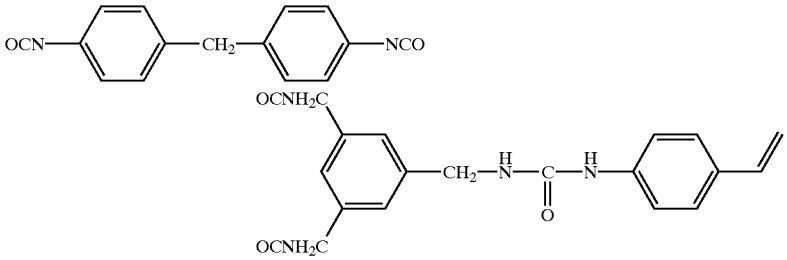 70 30 |
| 22 | 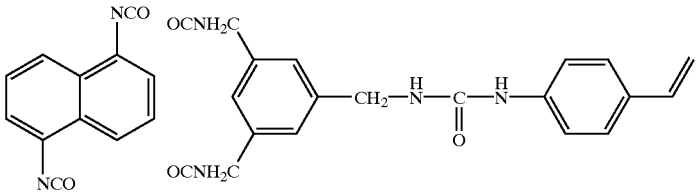 80 20 |
| 23 | 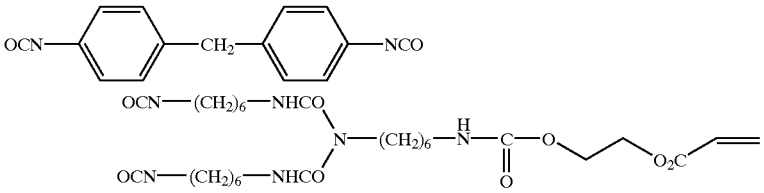 65 35 |

TABLE 4-continued
| Polyurethane Resins | Diol Compounds used (mol %) | Weight-Average Molecular Weight | Acid Value (meq/g) |
|---|---|---|---|
| 19 | 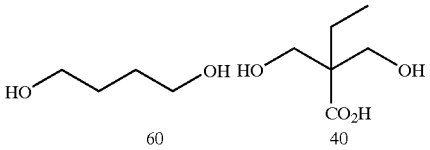 60 40 | 65,000 | 1.45 |
| 20 | 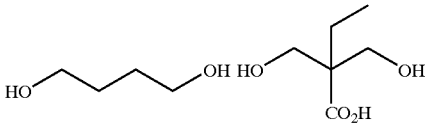 65 35 | 78,000 | 1.4 |
| 21 | 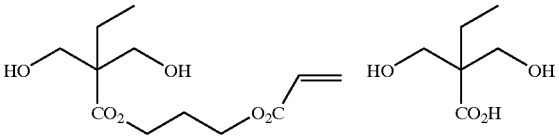 40 60 | 69,000 | 1.39 |
| 22 | 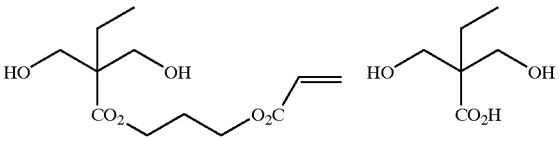 40 60 | 82,00 | 1.32 |
| 23 | 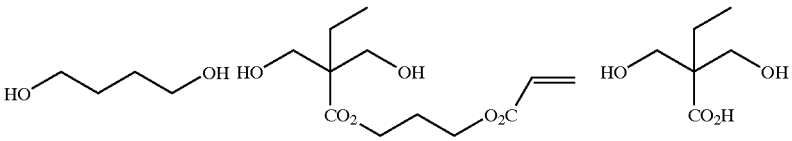 30 20 50 | 85 | 1.38 |
TABLE 5
| Polyurethane Resin | Diisocyanate Compounds used (mol %) |
|---|---|
| 24 | 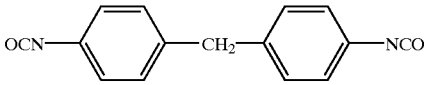 100 |
| 25 | 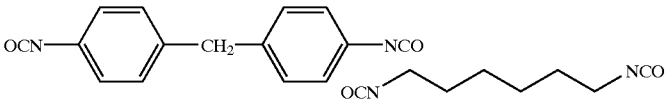 80 20 |
| 26 | 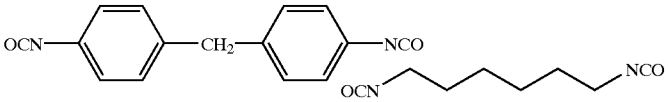 80 20 |

TABLE 5-continued
| | | | | | |
|---|---|---|---|---|---|
| 27 | 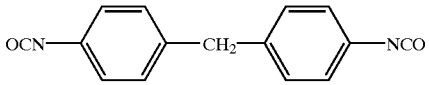 100 | | | | |
| 28 | 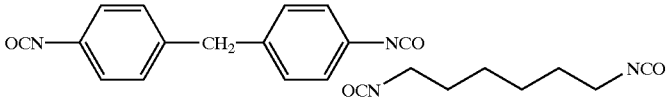 80 | | 20 | | |
| 29 | 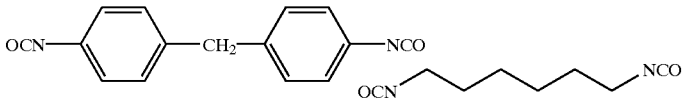 70 | | 30 | | |
| Polyurethane Resin | Diol Compounds used (mol %) | | | Weight-Average Molecular Weight | Acid Value (meq/g) |
| 24 | 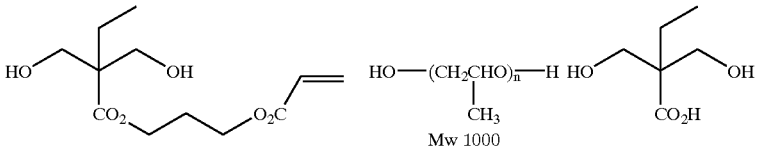 40 | Mw 1000 10 | 50 | 99,000 | 1.22 |
| 25 | 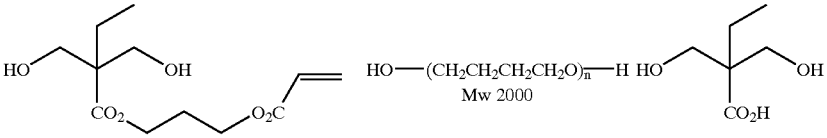 30 | Mw 2000 10 | 60 | 112,000 | 1.24 |
| 26 | 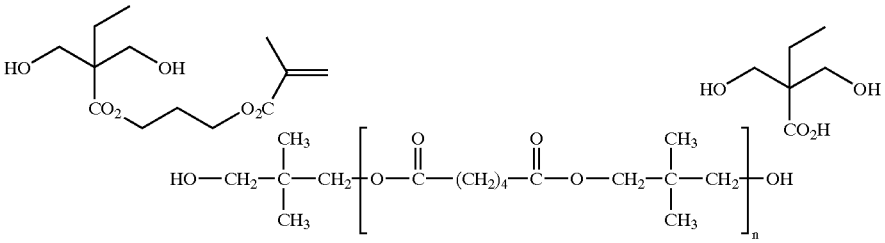 30 | Mw 1500 10 | 60 | 87,000 | 1.33 |
| 27 | 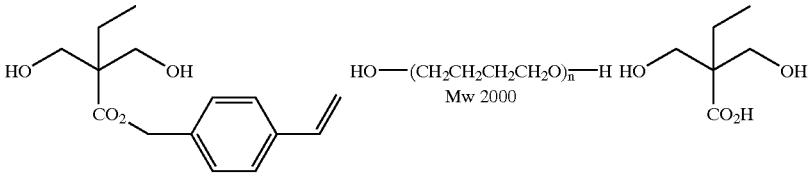 40 | Mw 2000 10 | 50 | 97,000 | 1.35 |
| 28 | 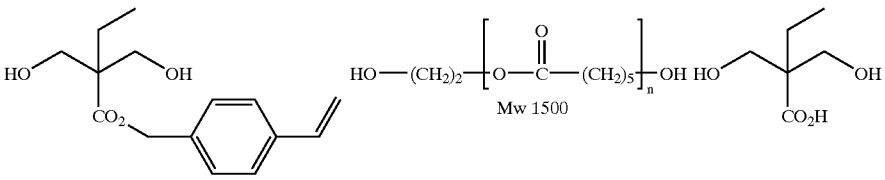 35 | Mw 1500 10 | 55 | 103,000 | 1.32 |

TABLE 5-continued

| | | | |
|---|---|---|---|
| 29 | 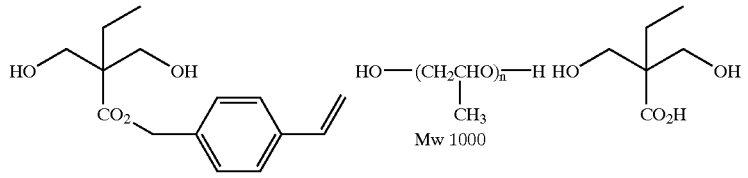 | 110,000 | 1.15 |

Examples 1 to 4, Comparative Examples 1 and 2

Preparation of Support

A melt of JIS A1050 alloy of at least 99.5% Al, containing 0.30% Fe, 0.10% Si, 0.02% Ti and 0.013% Cu was purified and cast. For purifying it, the alloy melt was degassed to remove the unnecessary gas such as hydrogen from it, and filtered through a ceramic tube filter. The alloy melt was cast using DC casting method. The solidified ingot having a thickness of 500 mm was cut to a depth of 10 mm from its surface, and then homogenized at 550° C. for 10 hours with preventing the intermetallic compound therein from growing into coarse grains. Next, this was hot-rolled at 400° C., then annealed in a continuous annealing furnace at 500° C. for 60 seconds (this is process annealing), and thereafter cold-rolled into an aluminium sheet having a thickness of 0.30 mm. In this, the surface roughness of the roll used was so controlled that the center line average height, Ra, of the cold-rolled aluminium sheet could be 0.2 μm. The aluminium sheet was leveled with a tension leveler to thereby further increase its surface smoothness.

Next, the aluminium sheet was subjected to surface treatment in the manner mentioned below, so that it could be a support of a planographic printing plate.

Specifically, to remove the rolling oil from its surface, the aluminium sheet was degreased with 10% sodium aluminate aqueous solution at 50° C. for 30 seconds, then neutralized with aqueous 30% sulfuric acid at 50° C. for 30 seconds, and then desmutted.

Next, the surface of the support was dressed and roughened with a so-called graining treatment to improve the adhesiveness between the aluminium sheet serving as a support and a recording layer to be formed thereon, and for ensuring water retentiveness in the non-image area of the printing plate having the aluminium sheet support. Specifically, an aqueous solution containing 1% nitric acid and 0.5% aluminium nitrate was prepared and kept at 45° C., and a web of the aluminium sheet was passed through it with applying an alternating electric current (duty ratio: 1/1) to the web from an indirect electric cell. The current density was 20 A/dm$^2$; and the electric power to the anode was 240 C/dm$^2$. After having been thus electrolytically dressed, the aluminium sheet web was etched in aqueous 10% sodium aluminate solution at 50° C. for 30 seconds, then neutralized in aqueous 30% sulfuric acid solution at 50° C. for 30 seconds, and thereafter desmutted.

To improve its wear resistance, chemical resistance and water retentiveness, the support was subjected to anodic oxidation to form an oxide film thereon. Specifically, the aluminium sheet web was passed through an aqueous solution of 20% sulfuric acid at 35° C., used as an electrolyte and electrolyzed therein with a direct current of 14 A/dm$^2$ being applied thereto from an indirect electric cell. Through the anodic oxidation, the aluminium sheet web had an oxide film of 2.5 g/m$^2$ formed thereon.

After wards, a silicate processing was performed. This treatment was to ensure the hydrophilicity of the non-image area of the printing plate having the aluminium sheet support. Specifically, the support was passed through aqueous 1.5% #3 sodium silicate solution at 70° C. The contact time was 15 seconds. Then, the support was washed with water. The amount of Si deposited on the web was 10 mg/m$^2$. The center line average height, Ra, of the thus-processed aluminium sheet was 0.25 μm. The aluminium sheet serves as the support of the printing plate produced herein.

Formation of Recording Layer

A coating liquid for recording layer (P-1) mentioned below was prepared. Using a wire bar, it was applied to the aluminium support prepared in the above manner, and dried in a hot air drier at 115° C. for 45 seconds to form a recording layer thereon. Thus, planographic printing plate precursors were produced. After being dried, the amount of the recording layer formed on each precursor was from 1.2 to 1.3 g/m$^2$.

The alkali-soluble polymers used in the examples are the specific polyurethane resins prepared in Synthetic Examples mentioned above. The structural units constituting the alkali-soluble polymer B-1 used in Comparative Example 1 are shown hereinafter. The radical-polymerizing compound DPHA is dipentaerythritol hexaacrylate.

<Coating Liquid for Recording Layer (P-1)>

Alkali-soluble polymer, component (A) (shown in Table 6 below along with its amount) Radical-polymerizing compound, component (D) (shown in Table 6 along with its amount)

| | |
|---|---|
| IR absorbent, IR-1, component (B) | 0.08 g |
| Polymerization initiator, S-1, component (C) | 0.30 g |
| Victoria Pure Blue naphthalenesulfonate | 0.04 g |
| Fluorine-containing surfactant (Dai-Nippon Ink Chemical Industry's MEGAPAC F-176) | 0.01 g |
| P-methoxyphenol | 0.001 g |
| Methyl ethyl ketone | 9.0 g |
| Methanol | 10.0 g |
| 1-Methoxy-2-propanol | 8.0 g |

IR-1

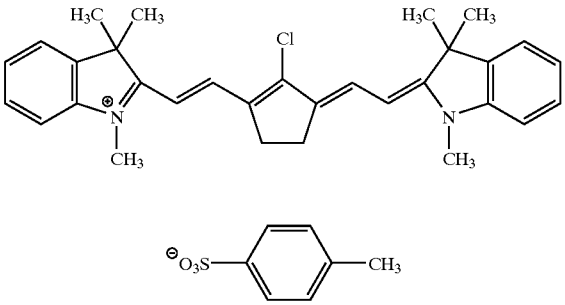

S-1

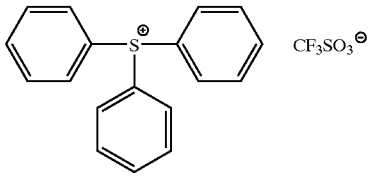

B-1

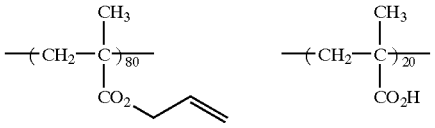

Mw 95,000

Exposure and Evaluation

The planographic printing plate precursors were image-wise exposed to IR rays, using Creo's TRENDSETTER 3244VFS with a water-cooling 40 W IR semiconductor laser mounted thereon. The laser power was 6.5 W; the drum revolution was 81 rpm; the energy on the plate was 188 mJ/cm$^2$; and the image resolution was 2400 dpi. After being exposed, the plates were visually checked for the presence or absence of layer ablation. The results are shown in Table 6.

TABLE 6

| | Amount of Alkali-soluble Polymer | Amount of Radical-polymerizing Compound | Ablation |
|---|---|---|---|
| Example 1 | polyurethane resin 1 2.0 g | no | no |
| Example 2 | polyurethane resin 2 2.0 g | no | no |
| Example 3 | polyurethane resin 1 1.0 g | DPHA 1.0 g | no |
| Example 4 | polyurethane resin 2 1.0 g | DPHA 1.0 g | no |
| Comparative Example 1 | B-1 2.0 g | no | yes |
| Comparative Example 2 | B-1 1.0 g | DPHA 1.0 g | yes |

As shown in Table 6, the planographic printing plate precursors of the Examples, in which the image-recording material of the present invention for the recording layer was used, did not undergo ablation while exposed to light, and a good image was formed thereon.

Examples 5 to 10, Comparative Examples 3, 4

The same aluminium support as in Example 1 was coated with a coating liquid for undercoat layer mentioned below, and dried at 80° C. for 30 seconds. The dry weight of the undercoat layer formed was 10 mg/m$^2$.

Coating Liquid for Undercoat Layer

Compounds of the following composition were mixed to prepare a coating liquid for undercoat layer.

| | |
|---|---|
| 2-Aminoethylphosphonic acid | 0.5 g |
| Methanol | 40 g |
| Pure water | 60 g |

A coating liquid for recording layer (P-2) mentioned below was prepared. Using a wire bar, it was applied to the undercoated aluminum support, and dried in a hot air drier at 115° C. for 45 seconds to form a recording layer thereon. Thus, planographic printing plate precursors were produced. The dry weight of the recording layer formed on each precursor was from 1.2 g/m$^2$ to 1.3 g/m$^2$.

The alkali-soluble polymers used in Examples are the specific polyurethane resins prepared in Synthetic Examples mentioned above. The structure of the radical-polymerizing compound U-1 is shown below.

<Coating Liquid for Recording Layer (P-2)>

Alkali-soluble polymer, component (A) (shown in Table 7 below along with its amount) Radical-polymerizing compound, component (D) (shown in Table 7 along with its amount)

| | |
|---|---|
| IR absorbent, IR-2, component (B) | 0.08 g |
| Polymerization initiator, S-2, component (C) | 0.30 g |
| Victoria Pure Blue naphthalenesulfonate | 0.04 g |
| Fluorine-containing surfactant (Dal-Nippon Ink Chemical Industry's MEGAFAC F-176) | 0.01 g |
| N-nitroso-N-phenylhydroxylamine aluminium | 0.001 g |
| Methyl ethyl ketone | 9.0 g |
| Methanol | 10.0 g |
| 1-Methoxy-2-propanol | 8.0 g |

IR-2

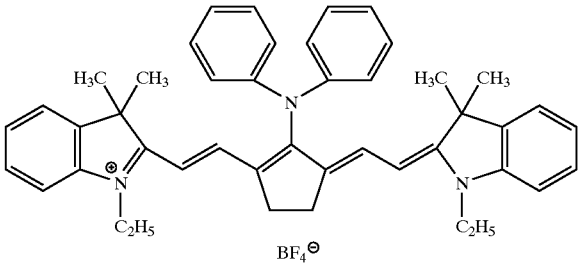

S-2

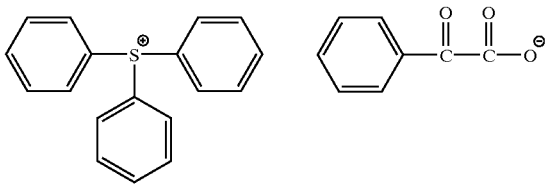

U-1

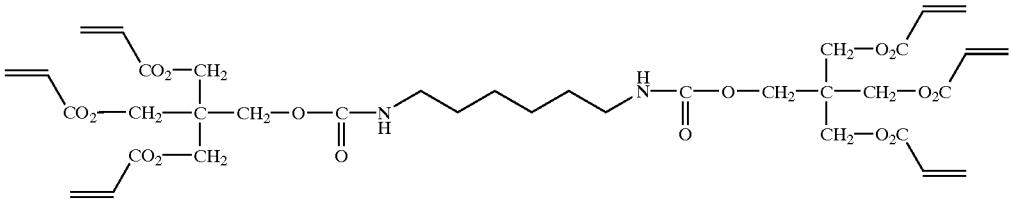

Exposure

The planographic printing plate precursors were image-wise exposed by IR rays, using Creo's TRENDSETTER 3244VFS with a water-cooling 40 W IR semiconductor laser mounted thereon. The laser power was 9 W; the drum revolution was 210 rpm; the energy on the plate was 133 mJ/cm$^2$; and the image resolution was 2400 dpi.

Development

After having been thus exposed, the plates were processed using an automatic processor, Fuji Photo Film's STABLON 900 NP. D-1, shown below, was used as the original developer, and D-2, shown below, was used as the replenisher. The temperature of the developer bath was 30° C., and the developing time was 12 seconds. The replenisher was automatically fed into the automatic processor in a controlled manner such that the developer in the developer bath could have a constant electroconductivity. Fuji Photo Film's FN-6, diluted with water to 1/1 was used as the finisher.

| Developer (D-1): | |
|---|---|
| Potassium hydroxide | 3 g |
| Potassium hydrogencarbonate | 1 g |
| Potassium carbonate | 2 g |
| Sodium sulfite | 1 g |
| Polyethylene glycol mononaphthyl ether | 150 g |
| Sodium dibutylnaphthalenesulfonate | 50 g |
| Tetrasodium Ethylenediaminetetraacetate | 8 g |
| Water | 785 g |
| Replenisher (D-2): | |
| Potassium hydroxide | 6 g |
| Potassium carbonate | 2 g |
| Sodium sulfite | 1 g |
| Polyethylene glycol mononaphthyl ether | 150 g |
| Sodium dibutylnaphthalenesulfonate | 50 g |

-continued

| | |
|---|---|
| Potassium salt of hydroxyethanesdiphosphonic acid | 4 g |
| Silicone TSA-731 (by Toshiba Silicone) | 0.1 g |
| Water | 786.9 g |

Evaluation of Printing Durability

The printing plates were tested in a Komori Corporation's printer, LITHLON, to check how many good prints could be obtained from them. Specifically, all the prints were visually checked for their ink density, and the number of good prints from each printing plate tested was counted. This indicates the printing durability of the plate tested. The results are given in Table 7.

TABLE 7

| | Amount of Alkali-soluble Polymer | Amount of Radical-polymerizing Compound | Printing Durability |
|---|---|---|---|
| Example 5 | polyurethane resin 1 2.0 g | no | 60,000 prints |
| Example 6 | polyurethane resin 2 2.0 g | no | 70,000 prints |
| Example 7 | polyurethane resin 3 2.0 g | no | 75,000 prints |
| Example 8 | polyurethane resin 2 1.0 g | DPHA 1.0 g | 65,000 prints |
| Example 9 | polyurethane resin 8 1.0 g | DPHA 1.0 g | 67,000 prints |
| Example 10 | polyurethane resin 5 1.0 g | U-1 1.0 g | 64,000 prints |
| Comparative Example 3 | B-1 2.0 g | no | 2,000 prints |
| Comparative Example 4 | B-1 1.0 g | DPHA 1.0 g | 10,000 prints |

From the data in Table 7, it is understood that the printing durability of the planographic printing plates of Examples, in which was used the image-recording material of the present invention for the recording layer, is better than those of Comparative Examples 3 and 4.

Examples 11 to 14, Comparative Example 5

Preparation of Support

Using a nylon brush, an aluminium sheet having a thickness of 0.30 mm was sand-blasted with an aqueous suspension of 400-mesh pumice stones, and then washed well with water. The sheet was etched by dipping it in 10 wt. % sodium hydroxide aqueous solution at 70° C. for 60 seconds, then washed with running water, neutralized and washed with 20 wt. % nitric acid, and washed again with water. The sheet was electrolytically roughened in aqueous 1 wt. % nitric acid solution with applying thereto an alternating sine-wave current under the condition of VA=12.7 V. The quantity of anode electricity was 160 coulombs/dm$^2$. The surface roughness (Ra) of the thus-processed sheet was 0.6 $\mu$m. Next, the sheet was desmutted by being dipped into 30 wt. % sulfuric acid aqueous solution at 55° C. for 2 minutes, and then subjected to anodic oxidation in 20 wt. % sulfuric acid aqueous solution for 2 minutes. The current density was 2 A/dm$^2$. The thickness of the oxide film formed on the sheet was 2.7 g/m$^2$. The coating liquid for undercoat layer mentioned above was applied to the aluminium sheet, and dried at 80° C. for 30 seconds. The dry weight of the undercoat layer formed on the sheet was 10 mg/m$^2$.

Formation of Recording Layer

A coating liquid for recording layer (P-3) mentioned below was prepared. Using a wire bar, the coating liquid was applied to the undercoated aluminium support, and dried in a hot air drier at 115° C. for 45 seconds to form a recording layer thereon. In that manner, planographic printing plate precursors were produced. The dry weight of the recording layer formed on each precursor was from 1.2 g/m$^2$ to 1.3 g/m$^2$. The precursors were exposed to scanning IR laser and developed into planographic printing plates, in the same manner as in Example 5.

The structural units constituting the alkali-soluble polymer, B-2 used in Comparative Example 6 are shown below. The structure of the radical-polymerizing compound, U-2 is also shown below.

<Coating Liquid for Recording Layer (P-3)>

Alkali-soluble polymer, component (A) (shown in Table 8 below along with its amount) Radical-polymerizing compound, component (D) (shown in Table 8 along with its amount)

| | |
|---|---|
| IR absorbent, IR-2, component (B) | 0.08 g |
| Sulfonium salt, S-1, component (C) | 0.30 g |
| Victoria Pure Blue naphthalenesulfonate | 0.04 g |
| Fluorine-containing surfactant (Dai-Nippon Ink Chemical Industry's MEGAFAC F-176) | 0.01 g |
| T-butylcatechol | 0.001 g |
| Methyl ethyl ketone | 9.0 g |
| Methanol | 10.0 g |
| 1-Methoxy-2-propanol | 8.0 g |

B-2

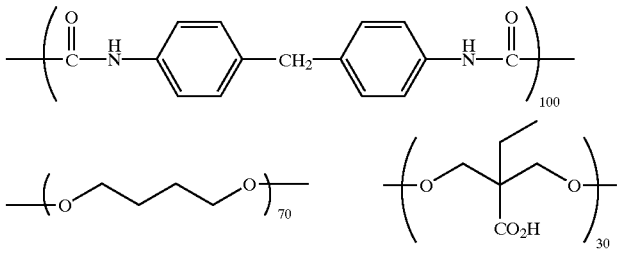

Mw 92,000

U-2

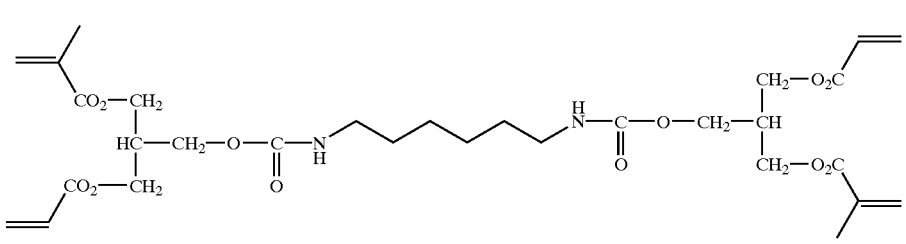

In the same manner as in the printing durability test method mentioned above, the printing plates were tested for sensitivity and the printing durability thereof and for the presence or absence of stains in prints. In addition, the printing plate precursors were forced to age at 60° C. for 3 days or at 45° C. and 75% RH for 3 days, and then processed and tested in the same manner as above. The results are shown in Table 8.

TABLE 8

| | Amount of Alkali-soluble Polymer | Amount of Radical-polymerizing Compound | Printing Durability/stains in non-image area of prints | | |
|---|---|---|---|---|---|
| | | | not forcedly aged | forcedly aged at 60° C. for 3 days | forcedly aged at 45° C. and 75% RH for 3 days |
| Example 11 | polyurethane resin 8 2.0 g | no | 60,000 prints with no stain found | 60,000 prints with no stain found | 60,000 prints with no stain found |
| Example 12 | polyurethane resin 5 2.0 g | no | 55,000 prints with no stain found | 55,000 prints with no stain found | 55,000 prints with no stain found |
| Example 13 | polyurethane resin 1 1.0 g | DPHA 0.5 g U-1 0.5 g | 65,000 prints with no stain found | 65,000 prints with no stain found | 65,000 prints with no stain found |
| Example 14 | polyurethane resin 2 1.0 g | DPHA 0.5 g U-2 0.5 g | 63,000 prints with no stain found | 63,000 prints with no stain found | 63,000 prints with no stain found |
| Comparative Example 5 | B-2 1.0 g | DPHA 0.5 g U-1 0.5 g | 20,000 prints with no stain found | 18,000 prints with stains found | 10,000 prints with stains found |

From Table 8, it is understood that the planographic printing plates, in which the image-recording material of the present invention was used as the recording layer, gave good prints with no stains in the non-image area, and have good printing durability. It is further understood that, even after stored in high-temperature and high-humidity atmosphere, the planographic printing plates still gave good prints with no stains in the non-image area and maintained good printing durability. This confirms the storage stability of the image-recording material of the present invention.

Examples 15 to 18, Comparative Example 6

Preparation of Support

Using a nylon brush, an aluminium sheet having a thickness of 0.30 mm was sand-blasted with an aqueous suspension of 400-mesh pumice stones, and then washed well with water. The aluminium sheet was etched by being dipped into 10 wt. % sodium hydroxide aqueous solution at 70° C. for 60 seconds, then washed with running water, neutralized and washed with 20 wt. % nitric acid, and washed again with water. The aluminium sheet was electrolytically roughened in a 1 wt. % nitric acid aqueous solution while applying thereto an alternating sine-wave current under the condition of VA=12.7 V. The quantity of anode electricity was 160 coulombs/dm$^2$. The surface roughness (Ra) of the thus-processed sheet was 0.6 $\mu$m. Next, this was desmutted by dipping it in 30 wt. % sulfuric acid aqueous solution at 55° C. for 2 minutes, and then subjected to anodic oxidation in 20 wt. % sulfuric acid aqueous solution for 2 minutes. The current density was 2 A/dm$^2$. The thickness of the oxide film formed on the sheet was 2.7 g/m$^2$.

Formation of Undercoat Layer

A liquid composition (sol) was prepared according to an SG method mentioned below.

The sol composition is as follows:

| | |
|---|---|
| Methanol | 130 g |
| Water | 20 g |
| 85 wt. % phosphoric acid | 16 g |
| Tetraethoxysilane | 50 g |
| 3-Methacryloxypropyltrimethoxysilane | 60 g |

These compounds were mixed and stirred. After about 5 minutes, the resulting mixture produced heat. This was reacted for 60 minutes in that condition, and then transferred into a separate chamber. 3000 g of methanol was added to it to prepare a sol.

The sol was diluted with methanol/ethylene glycol (9/1 by weight), and applied onto the substrate in a controlled manner such that the amount of Si on the substrate could be 30 mg/m$^2$. Then, this was heated at 100° C. for 1 minute.

Using a wire bar, a coating liquid for the recording layer (P-4) having the composition mentioned below was applied onto the thus-undercoated aluminium support, and dried in a hot air drier at 115° C. for 45 seconds. In that manner, planographic printing plate precursors were fabricated. The dry weight of the recording layer formed was from 1.2 g/m$^2$ to 1.3 g/m$^2$.

<Coating Liquid for Recording Layer (P-4)>

Alkali-soluble polymer, component (A) (shown in Table 9 below along with its amount) Radical-polymerizing compound, component (D) (shown in Table 9 along with its amount)

| | |
|---|---|
| IR absorbent, IR-1, component (B) | 0.08 g |
| Sulfonium salt, S-1, component (C) | 0.30 g |
| Victoria Pure Blue naphthalenesulfonate | 0.04 g |
| fluorine-containing surfactant (Dai-Nippon Ink Chemical Industry's MEGAFAC F-176) | 0.01 g |
| Methyl ethyl ketone | 9.0 g |
| Methanol | 10.0 g |
| P-methoxyphenol | 0.001 g |
| 1-Methoxy-2-propanol | 8.0 g |
| Exposure: | |

Exposure

The planographic printing plate precursors were image-wise exposed to light, using Fuji Photo Film's LUXEL T-9000 CTP with a multi-channel laser head mounted thereon. The laser power/beam was 250 mW; the drum revolution was 800 rpm; and the image resolution was 2400 dpi.

Development

After having been thus exposed, the plates were processed by the use of an automatic processor, Fuji Photo Film's STABLON 900 N. For both the original developer and the replenisher, used was Fuji Photo Film's DP-4, diluted with water to ⅛, was used. The temperature of the developer bath was 30° C. For the finisher, used was Fuji Photo Film's GU-7, diluted with water to ½, was used.

Evaluation of Printing Durability, and Stains in Printed Matters

The printing plates were tested in a printer, HEIDELBERG SOR-KZ to check how many good prints could be obtained from them. Specifically, all the prints were visually checked for their ink density, and the number of good prints from each printing plate tested was counted. This indicates the printing durability of the plate tested. In addition, the prints were visually checked for the presence or absence of stains in the non-image area. The results are given in Table 9.

TABLE 9

| | Amount of Alkali-soluble Polymer | Amount of Radical-polymerizing Compound | Printing Durability |
|---|---|---|---|
| Example 15 | polyurethane resin 2 2.0 g | no | 80,000 prints |
| Example 16 | polyurethane resin 2 1.0 g | DPHA 1.0 g | 82,000 prints |
| Example 17 | polyurethane resin 24 2.0 g | DPHA 0.5 g U-2 0.5 g | 85,000 prints |
| Example 18 | polyurethane resin 27 1.0 g | DPHA 0.5 g U-1 0.5 g | 81,000 prints |
| Comparative Example 6 | B-2 1.0 g | DPHA 0.5 g U-2 0.5 g | 20,000 prints |

From Table 9, it can be understood that the planographic printing plates of Examples, in which was used the image-recording material of the present invention as the recording layer, gave good prints with no stains in the non-image areas and had good printing durability.

the image-recording material of the present invention contains a polyurethane resin that has a specific unsaturated group in the side-chain branches thereof, which enables good image recording thereon and the strength of the image area formed is high. In cases where the image-recording material of the present invention is used for the recording layer of planographic printing plate precursors, the precursors can be imagewise processed through exposure to IR laser, without undergoing ablation. The printing plates from the precursor have good printing durability.

Although the present invention has been described in detail and with reference to specific embodiments thereof, it will be apparent to one skilled in the art that various changes and modifications can be made thereto without departing from the spirit and scope thereof.

What is claimed is:

1. A negative image-recording material for heat-mode exposure, which is able to form images by heat-mode exposure, comprising:

a polyurethane resin having at least one or more side-chain branches of the following general formulae (1) to (3), which polyurethane resin is soluble in an alkaline aqueous solution;

a photo-thermal converting agent; and a compound which generates a radical through heat-mode exposure to light of a wavelength which wavelength can be absorbed by the photo-thermal converting agent.

(1)

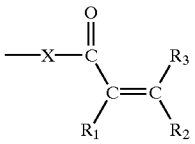

(2)

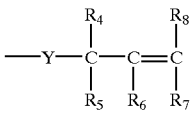

-continued (3)

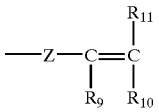

wherein $R^1$ to $R^{11}$ each independently represents a monovalent organic group; X and Y each independently represents an oxygen atom, a sulfur atom, or —N($R^{12}$)—; Z represents one of an oxygen atom, a sulfur atom, —N($R^{13}$)—, and an optionally-substituted phenylene group; $R^{12}$ represents a hydrogen atom or a monovalent organic group; and $R^{13}$ represents a hydrogen atom or a monovalent organic group.

2. The negative image-recording material for heat-mode exposure according to claim 1, wherein: $R^1$ in formula (1) is selected from a hydrogen atom and an optionally-substituted alkyl group; $R^2$ and $R^3$ are independently selected from a group consisting of a hydrogen atom, a halogen atom, an amino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group and an optionally-substituted arylsulfonyl group; X is selected from an oxygen atom, a sulfur atom and —N($R^{12}$)—; $R^{12}$ is selected from a hydrogen atom and an optionally-substituted alkyl group; and the substituents are independently selected from a group consisting of an alkyl group, an alkenyl group, an alkynyl group, an aryl group, an alkoxy group, an aryloxy group, a halogen atom, an amino group, an alkylamino group, an arylamino group, a carboxyl group, an alkoxycarbonyl group, a sulfo group, a nitro group, a cyano group, an amido group, an alkylsulfonyl group and an arylsulfonyl group.

3. The negative image-recording material for heat-mode exposure according to claim 1, wherein: $R^4$, $R^5$, $R^6$, $R^7$ and $R^8$ in formula (2) are independently selected from a group consisting of a hydrogen atom, a halogen atom, an amino group, a dialkylamino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group and an optionally-substituted arylsulfonyl group; Y is selected from an oxygen atom, a sulfur atom and —N($R^{12}$)—; $R^{12}$ is selected from a hydrogen atom and an optionally-substituted alkyl group; and the substituents are independently selected from a group consisting of an alkyl group, an alkenyl group, an alkynyl group, an aryl group, an alkoxy group, an aryloxy group, a halogen atom, an amino group, an alkylamino group, an arylamino group, a carboxyl group, an alkoxycarbonyl group, a sulfo group, a nitro group, a cyano group, an amido group, an alkylsulfonyl group and an arylsulfonyl group.

4. The negative image-recording material for heat-mode exposure according to claim 1, wherein: $R^9$ in formula (3) is selected from a hydrogen atom and an optionally-substituted alkyl group; $R^{10}$ and $R^{11}$ are independently selected from a group consisting of a hydrogen atom, a halogen atom, an amino group, a dialkylamino group, a carboxyl group, an alkoxycarbonyl group, a sulfo group, a nitro group, a cyano group, an optionally-substituted alkyl group, an optionally-substituted aryl group, an optionally-substituted alkoxy group, an optionally-substituted aryloxy group, an optionally-substituted alkylamino group, an optionally-substituted arylamino group, an optionally-substituted alkylsulfonyl group and an optionally-substituted arylsulfonyl group; Z is selected from an oxygen atom, a sulfur atom, —N($R^{13}$)—, and an optionally-substituted phenylene group; $R^{13}$ is an optionally-substituted alkyl group, and the substituents are independently selected from a group consisting of an alkyl group, an alkenyl group, an alkynyl group, an aryl group, an alkoxy group, an aryloxy group, a halogen atom, an amino group, an alkylamino group, an arylamino group, a carboxyl group, an alkoxycarbonyl group, a sulfo group, a nitro group, a cyano group, an amido group, an alkylsulfonyl group and an arylsulfonyl group.

5. The negative image-recording material for heat-mode exposure according to claim 1, wherein: the basic skeleton of the polyurethane resin comprises structural units of a reaction product of at least one diisocyanate compound of the following general formula (4) and at least one diol compound of the following general formula (5):

$$OCN—X^0—NCO \quad (4)$$

$$HO—Y^0—OH \quad (5)$$

wherein $X^0$ and $Y^0$ each independently represents a divalent organic residue.

6. The negative image-recording material for heat-mode exposure according to claim 5, wherein at least one of the diisocyanate compounds of formula (4) and the diol compounds of formula (5) has at least one group of the formulae (1) to (3).

7. The negative image-recording material for heat-mode exposure according to claim 6, wherein the diol compounds of formula (5) comprise: at least one diol compound having at least one group of the formulae (1) to (3); and at least one other diol compound selected from a group consisting of polyether-diol compounds, polyester-diol compounds and polycarbonate-diol compounds, the polyether-diol compounds, the polyester-diol compounds and the polycarbonate-diol compounds each having a weight-average molecular weight of at least 500.

8. The negative image-recording material for heat-mode exposure according to claim 5, wherein the diol compounds of formula (5) are obtained through a reaction of any of halogenodiol compounds, triol compounds and aminodiol compounds with any of carboxylic acids having an unsaturated group, acid chlorides having an unsaturated group, isocyanates having an unsaturated group, alcohols having an unsaturated group, amines having an unsaturated group, thiols having an unsaturated group, and halogenoalkyl compounds having an unsaturated group.

9. The negative image-recording material for heat-mode exposure according to claim 1, wherein the weight-average molecular weight of the polyurethane resin is at least 10,000.

10. The negative image-recording material for heat-mode exposure according to claim 1, wherein the solid content of the polyurethane resin is from 10% to 95% by weight.

11. The negative image-recording material for heat-mode exposure according to claim 1, wherein the photo-thermal converting agent is selected from a group consisting of cyanine dyes, squarylium dyes, pyrylium salts, nickel-thiolate salts and nickel-thiolate complexes.

12. The negative image-recording material for heat-mode exposure according to claim 1, wherein the photo-thermal converting agent is selected from a group consisting of insoluble azo pigments, azo-lake pigments, condensed azo pigments, chelate-azo pigments, phthalocyanine pigments, anthraquinone pigments, perylene and perinone pigments, thioindigo pigments, quinacridone pigments, dioxazine pigments, isoindolinone pigments, quinophthalone pigments, dyed lake pigments, azine pigments, nitroso pigments, nitro pigments, natural pigments, fluorescent pigments, inorganic pigments, and carbon black.

13. The negative image-recording material for heat-mode exposure according to claim 1, wherein the radical-generating compound is selected from a group consisting of onium salts, trihalomethyl group-having triazine compounds, peroxides, azo-type polymerization initiators, azide compounds, and quinonediazides.

14. The negative image-recording material for heat-mode exposure according to claim 1, wherein the radical-generating compound is an onium salt selected from a group consisting of iodonium salts, diazonium salts and sulfonium salts.

15. The negative image-recording material for heat-mode exposure according to claim 1, which comprises a radical-polymerizing compound.

16. The negative image-recording material for heat-mode exposure according to claim 15, wherein the radical-polymerizing compound has at least one ethylenic unsaturated double bond.

17. The negative image-recording material for heat-mode exposure according to claim 15, wherein the ratio of the polyurethane resin to the radical-polymerizing compound is from 1:0.05 to 1:3 by weight.

* * * * *